US010876374B2

(12) United States Patent
Mhaskar et al.

(10) Patent No.: US 10,876,374 B2
(45) Date of Patent: Dec. 29, 2020

(54) DEGRADABLE PLUGS

(71) Applicant: Weatherford Technology Holdings, LLC., Houston, TX (US)

(72) Inventors: Nauman H. Mhaskar, Cypress, TX (US); Deborah Lynn Banta, Houston, TX (US); James Rochen, Waller, TX (US)

(73) Assignee: Weatherford Technology Holdings, LLC, Houston, TX (US)

( * ) Notice: Subject to any disclaimer, the term of this patent is extended or adjusted under 35 U.S.C. 154(b) by 146 days.

(21) Appl. No.: 16/193,675

(22) Filed: Nov. 16, 2018

(65) Prior Publication Data

US 2020/0157912 A1 May 21, 2020

(51) Int. Cl.

| | |
|---|---|
| ***E21B 33/12*** | (2006.01) |
| ***E21B 33/129*** | (2006.01) |
| *E21B 43/26* | (2006.01) |

(52) U.S. Cl.

CPC ..... *E21B 33/1208* (2013.01); *E21B 33/1293* (2013.01); *E21B 43/26* (2013.01)

(58) Field of Classification Search

CPC .. E21B 33/1208; E21B 33/1293; E21B 43/26; E21B 33/12; E21B 33/134; E21B 23/00

See application file for complete search history.

(56) References Cited

U.S. PATENT DOCUMENTS

| | | | |
|---|---|---|---|
| 4,367,468 | A | 1/1983 | Curry |
| 5,398,763 | A | 3/1995 | Watson et al. |
| 5,941,313 | A | 8/1999 | Arizmendi |
| 6,142,231 | A | 11/2000 | Myers, Jr. et al. |
| 6,394,184 | B2 | 5/2002 | Tolman et al. |
| 7,044,230 | B2 | 5/2006 | Starr et al. |
| 7,168,494 | B2 | 1/2007 | Starr et al. |
| 7,350,582 | B2 | 4/2008 | McKeachnie et al. |

(Continued)

FOREIGN PATENT DOCUMENTS

| | | |
|---|---|---|
| WO | 1993015306 | 8/1993 |
| WO | 2014062200 | 12/2014 |

(Continued)

OTHER PUBLICATIONS

PCT Search Report and Written Opinion in co-pending PCT Application No. PCT/US2016/039063, dated Sep. 13, 2016, 12-pgs.

(Continued)

*Primary Examiner* — Brad Harcourt

(74) *Attorney, Agent, or Firm* — Vorys, Sater, Seymour and Pease LLP

(57) ABSTRACT

A downhole apparatus for use in a tubular can include: a mandrel having a first end shoulder; a first slip disposed on the mandrel adjacent the first end shoulder and abutting against a mule shoe; a cone disposed on the mandrel adjacent the first slip and movable relative to the first end shoulder to engage the first slip toward the tubular; a seal element disposed on the mandrel adjacent the cone and being expandable outward from the mandrel; and wherein at least one component selected from the group consisting of the mandrel, the first slip, the cone, the seal element, and the mule shoe is a filler-doped degradable component that comprise a degradable material and a filler.

20 Claims, 20 Drawing Sheets

(56) References Cited

U.S. PATENT DOCUMENTS

| | | | |
|---|---|---|---|
| 7,699,101 | B2 | 4/2010 | Fripp et al. |
| 8,267,177 | B1 | 9/2012 | Vogel et al. |
| 8,424,610 | B2 | 4/2013 | Newton et al. |
| 9,010,442 | B2 | 4/2015 | Streich et al. |
| 9,033,041 | B2 | 5/2015 | Baihly et al. |
| 9,033,046 | B2 | 5/2015 | Andrew et al. |
| 9,080,098 | B2 | 7/2015 | Xu et al. |
| 9,366,106 | B2 | 6/2016 | Xu et al. |
| 9,789,663 | B2 | 10/2017 | Zhang et al. |
| 9,835,016 | B2 | 12/2017 | Zhang et al. |
| 9,920,585 | B2 | 3/2018 | Murphree et al. |
| 9,932,796 | B2 | 4/2018 | Walton et al. |
| 10,000,991 | B2 | 6/2018 | Harris |
| 10,082,008 | B2 | 9/2018 | Robey et al. |
| 2005/0205264 | A1 | 9/2005 | Starr et al. |
| 2005/0205265 | A1 | 9/2005 | Todd et al. |
| 2005/0205266 | A1 | 9/2005 | Todd et al. |
| 2007/0131413 | A1 | 6/2007 | Millet et al. |
| 2007/0277979 | A1 | 12/2007 | Todd et al. |
| 2008/0271898 | A1 | 11/2008 | Turley et al. |
| 2010/0101803 | A1 | 4/2010 | Cayton et al. |
| 2010/0101807 | A1 | 4/2010 | Greenlee et al. |
| 2011/0048743 | A1 | 3/2011 | Stafford et al. |
| 2012/0061102 | A1 | 3/2012 | Holderman et al. |
| 2012/0205091 | A1 | 8/2012 | Turley |
| 2013/0240200 | A1 | 9/2013 | Frazier |
| 2013/0299192 | A1 | 11/2013 | Xu et al. |
| 2013/0300066 | A1 | 11/2013 | Xu et al. |
| 2014/0014371 | A1 | 1/2014 | Jacob et al. |
| 2014/0041857 | A1 | 2/2014 | Xu et al. |
| 2014/0110112 | A1 | 4/2014 | Jordan, Jr. |
| 2014/0190685 | A1 | 7/2014 | Frazier et al. |
| 2014/0202708 | A1 | 7/2014 | Jacob et al. |
| 2014/0251612 | A1 | 9/2014 | Powers |
| 2015/0129215 | A1 | 5/2015 | Xu et al. |
| 2015/0129239 | A1 | 5/2015 | Richard |
| 2015/0252646 | A1* | 9/2015 | Okura ..... B29C 48/911 166/192 |
| 2015/0300121 | A1 | 10/2015 | Xu |
| 2015/0337618 | A1 | 11/2015 | Hern et al. |
| 2016/0145486 | A1 | 5/2016 | Weaver et al. |
| 2016/0201425 | A1 | 7/2016 | Walton et al. |
| 2016/0201427 | A1 | 7/2016 | Fripp et al. |
| 2016/0201435 | A1 | 7/2016 | Fripp et al. |
| 2016/0230498 | A1 | 8/2016 | Walton et al. |
| 2016/0258241 | A1 | 9/2016 | Streich et al. |
| 2016/0273299 | A1 | 9/2016 | Fripp et al. |
| 2016/0312112 | A1 | 10/2016 | Ogle et al. |
| 2016/0376869 | A1 | 12/2016 | Rochen et al. |
| 2017/0152371 | A1 | 6/2017 | Duan et al. |
| 2017/0191354 | A1 | 7/2017 | Acker et al. |
| 2017/0197330 | A1 | 7/2017 | Surjaatmadja |
| 2017/0314359 | A1 | 11/2017 | Fripp et al. |
| 2018/0163503 | A1 | 6/2018 | Fripp et al. |
| 2018/0171737 | A1 | 6/2018 | Xu et al. |
| 2018/0216431 | A1 | 8/2018 | Walton, III et al. |
| 2018/0223624 | A1 | 8/2018 | Fripp et al. |
| 2018/0230769 | A1 | 8/2018 | Xu et al. |
| 2018/0238133 | A1 | 8/2018 | Fripp et al. |
| 2018/0245422 | A1 | 8/2018 | Fripp et al. |
| 2018/0252067 | A1 | 9/2018 | Fripp et al. |
| 2018/0283121 | A1 | 10/2018 | Zhang et al. |
| 2018/0283141 | A1 | 10/2018 | Zhang et al. |
| 2018/0283142 | A1 | 10/2018 | Zhang et al. |
| 2018/0320472 | A1 | 11/2018 | Fripp et al. |

FOREIGN PATENT DOCUMENTS

| | | |
|---|---|---|
| WO | 2014193697 | 12/2014 |
| WO | 2016204814 | 12/2016 |
| WO | 2016204886 | 12/2016 |

OTHER PUBLICATIONS

The ISRWO of related PCT/US2019/060076 with mail date of Mar. 11, 2020.

* cited by examiner

DEGRADABLE PLUGS

BACKGROUND

The present application relates to degradable plugs.

In wellbore construction and completion operations, a wellbore is formed to access hydrocarbon-bearing formations (e.g., crude oil and/or natural gas) by drilling a wellbore. Drilling is accomplished by utilizing a drill bit that is mounted on the end of a drill string. To drill the wellbore to a predetermined depth, the drill string is often rotated by a top drive or rotary table on a surface platform or rig, and/or by a downhole motor mounted towards the lower end of the drill string.

After drilling to the predetermined depth, the drill string and drill bit are removed and a section of casing is lowered into the wellbore. An annulus is thus formed between the string of casing and the formation, as the casing string is hung from the wellhead. A cementing operation is then conducted to fill the annulus with cement. The casing string is cemented into the wellbore by circulating cement into the annulus defined between the outer wall of the casing and the borehole. The combination of cement and casing strengthens the wellbore and facilitates the isolation of certain areas of the formation behind the casing for the production of hydrocarbons.

Once the casing has been cemented, the casing may be perforated to gain access to the surrounding formation. For example, the casing and surrounding cement are perforated with holes or perforations to communicate the casing with the surrounding formation. Using such perforations, operators can perform any number of operations, such as hydraulic fracturing or dispensing acid or other chemicals into the producing formation. Additionally, the perforations can be used for production flow into a producing string disposed in the casing during producing operations.

Several techniques are currently used to produce perforations in casings to create a flow path. Most of the techniques require a workover rig or a coiled tubing (CT) unit to be used. "Plug-and-pert" is a common technique used to perforate and treat wells with cemented casing. In this technique, an isolation plug is run on wireline along with a setting tool and perforating gun(s) into the cemented casing. The plug is set in the casing with the setting tool, and the perforating gun(s) are used to perforate the casing. The running tool and perforating gun(s) are then removed, a ball is deployed to the set plug, and fracture treatment is pumped downhole to the newly created perforations. When treatment of this stage is finished, the plug and perforation tools are installed for the next zone to be plugged, perforated, and then treated. Details of such a system are disclosed in U.S. Pat. No. 6,142,231, for example, which is incorporated herein by reference.

The isolation plugs may be retrievable, and retrieval operations can remove the retrievable plugs so production and the like can commence. Alternatively, the isolation plugs may be expendable and composed of a composite material. Once treatment operations are completed, the various plugs left inside the casing can be milled out in a milling operation. As will be appreciated, retrieving the plugs and milling out the plugs can both take a considerable amount of time and can increase operation costs.

For these reasons, operators have developed isolation plugs that are dissolvable. For example, Magnum Oil Tools offers a MAGNUM VANISHING PLUG™ (MVP™) composite frac plug that is engineered to dissolve in the common temperature and pressure ratings downhole so that flowback in the tubing can be established without the need for milling.

Schlumberger offers the Infinity Dissolvable Plug-and-Perf System that uses degradable fracturing balls and seats to isolate zones during stimulation. In this system, receptacles are initially run downhole on the casing and cemented with the casing in the wellbore. To perform plug and pert operations, a seat is run downhole on a perforating gun. When positioned near the location on the casing for the seat to be set, a setting tool activates the seat so that it will engage in the receptacle when moved further downhole. The seat is left in the receptacle as the perforating gun is raised and used to make perforations in the casing. After the gun is removed, a dissolvable ball is then deployed to the seat, and treatment fluid is pumped into the formation through the perforations. Operations on additional stages can also be performed. Eventually, the balls and seats remaining in the casing will dissolve. Examples of such a system are disclosed in U.S. Pat. No. 9,033,041 and U.S. Pat. App. Nos. 2014/0014371 and 2014/0202708.

However, in each of the foregoing examples, the degradable portions of the downhole tool are composed of an expensive degradable material, which results in a costly downhole operation.

BRIEF DESCRIPTION OF THE DRAWINGS

The following figures are included to illustrate certain aspects of the embodiments, and should not be viewed as exclusive embodiments. The subject matter disclosed is capable of considerable modifications, alterations, combinations, and equivalents in form and function, as will occur to those skilled in the art and having the benefit of this disclosure.

FIGS. 1F-1, 1F-2, and 1F-3 illustrate details of the expansion element or rings for the disclosed plug.

DETAILED DESCRIPTION

Figure 1A:
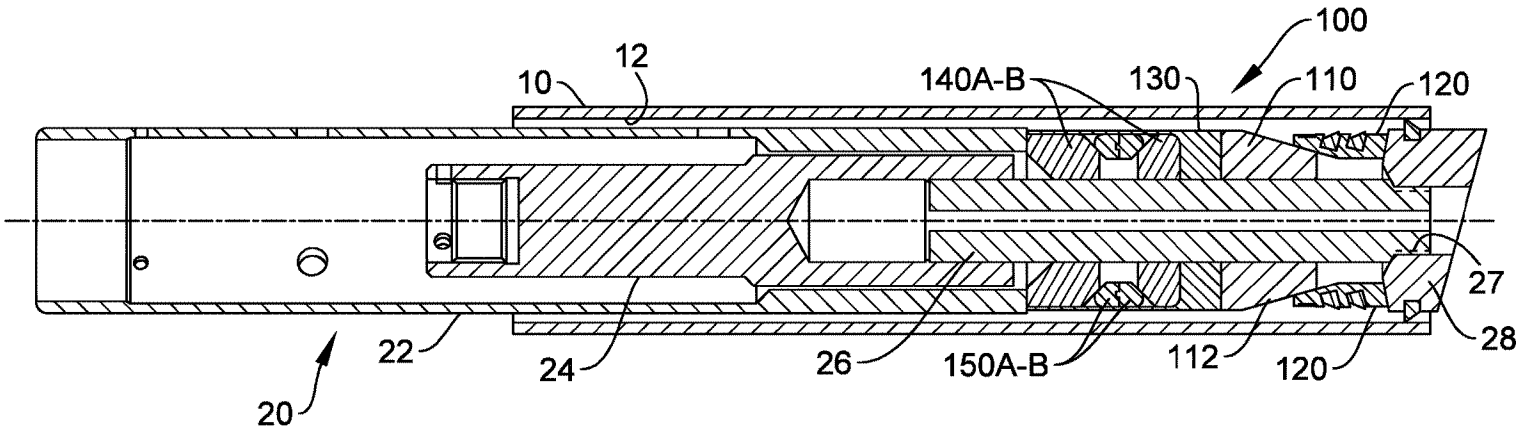
FIGS. 1A-1C illustrate cross-sectional views of a first degradable plug according to the present disclosure during stages of setting in tubing.

The present application relates to degradable plugs. More specifically, the present application relates to degradable plugs comprising filler-doped degradable components that can significantly reduce the cost of the overall degradable plug at least by decreasing the amount of degradable material needed to create the plug.

In some instances, a component preform comprising a filler and degradable adhesive in a desired shape is used in the production of a filler-doped degradable component, where the component preform is encased in the degradable material to form the filler-doped degradable component.

As used herein, the term "encase," "encasing," "encased," and grammatical variants thereof when describing a preform that is completely covered with a material such that the preform is not exposed to the outer environment. The terms do not imply a method by which the encapsulating shell is applied or a thickness thereof. Further, depending on the porosity of the preform, the viscosity of the encasing material, and the method of encasement, the encasing material can intercalate into some, all, or none of the interstitial spaces of the preform.

As used herein, the terms "degradable" and all of its grammatical variants (e.g., "degrade," "degradation," "degrading," "dissolve," dissolving," and the like), refer to the chemically and/or biologically dissolution and/or decomposition of solid materials. Degradation results in a loss of mass and/or reduction in structural integrity. Examples of pathways by which a material can degrade may include, but are not limited to, solubilization, hydrolytic degradation, biological dissolution and/or decomposition (e.g., via bacteria or enzymes), chemical reactions (e.g., electrochemical reactions, galvanic reactions, and corrosion), thermal reactions, reactions induced by radiation, or combinations thereof.

The conditions for degradation are generally wellbore conditions where an external stimulus may be used to initiate and/or affect the rate of degradation. The external stimulus can be naturally occurring in the wellbore (e.g., pressure, temperature, fluids) or introduced into the wellbore (e.g., fluids, chemicals). For example, the pH of the fluid that interacts with the material may be changed by introduction of an acid or a base, or an electrolyte may be introduced or naturally occurring to induce galvanic corrosion. The terms "wellbore environment" and all of its grammatical variants include both naturally occurring wellbore environments and materials or fluids introduced into the wellbore.

Examples of degradable materials may include, but are not limited to, degradable polymers, degradable metals, and the like.

Degradable polymers may exhibit a degradation rate of about 0.01 millimeters per hour (mm/hr) in fresh water (e.g., tap water) at 250° F. (121° C.). Examples of degradable polymers may include, but are not limited to, polylactic acid (PLA), polyglycolic acid (PGA), lactic acid/glycolic acid copolymer (PLGA), polyvinyl alcohol, polysaccharides, starches, polyanhydrides, polyorthoesters, polycaprolactones, and combinations thereof.

Degradable metals may exhibit a degradation rate of about 0.1 mg/cm$^2$/hour to about 450 mg/cm$^2$/hour determined in aqueous 3 wt % KCl solution at 93° C. Examples of degradable metals (e.g., via galvanic corrosion in brine) may include, but are not limited to, nickel, nickel-copper alloys, nickel-chromium alloys, aluminum, aluminum alloys (e.g., silumin alloys, magnalium alloys, aluminum-gallium alloys, aluminum-indium alloys, aluminum-gallium-indium alloys, aluminum-gallium-bismuth-tin alloys), copper, copper alloys (e.g., brass, bronze), chromium, tin, tin alloys (e.g., pewter, solder), iron, iron alloys (e.g., cast iron, pig iron), zinc, zinc alloys (e.g., zamak), magnesium, magnesium alloys (e.g., ELEKTRON™ (available from Magnesium Electron Ltd.), magnox, magnesium-lithium alloys), beryllium, beryllium alloys (e.g., beryllium-copper alloys, beryllium-nickel alloys), calcium alloys (e.g., calcium-lithium alloys, calcium-magnesium alloys, calcium-aluminum alloys, calcium-zinc alloys, calcium-lithium-zinc), and any combination thereof.

The degradable materials are doped with one or more fillers. The one or more fillers can be degradable or nondegradable in the wellbore environment. Examples of fillers include, but are not limited to, glass and ceramic particles, polymer particles, metal particles, salts, and combinations thereof. Preferably, the fillers are chosen to have a lower cost than the degradable material and impart sufficient strength to the filler-doped degradable component.

As used herein, the terms "particle," "particulate," and all of their grammatical variants are not limited by shape but do have an aspect ratio of about 1 to about 4. Examples of shapes may include, but are not limited to, spheroid, prolate spheroid, oblate spheroid, ellipsoid, cylindrical with flat or rounded ends, polygonal (e.g., cuboid, pyramidal, and the like) with sharp or rounded edges, and the like. Each of the foregoing shape terms encompass the corresponding shape with surface irregularities.

Examples of glass and ceramic particles may include, but are not limited to, glass beads, hollow glass beads, sand, aluminum oxide particles, aluminum oxide particles, silicon carbide particles, tungsten carbide particles, and combinations thereof.

Examples of particles may include, but are not limited to, titanium particles, platinum particles, rhodium particles, gold particles, gold-platinum alloy particles, silver particles, and combinations thereof.

Examples of polymers particles may include, but are not limited to, low-density polyethlyene, high density polyethylene, polypropylene, polyethlyene oxide, polypropylene oxide, polytetrafluoroethylene, phenolic resins, polyether ether ketone, nylon, and the like, and combinations thereof.

Examples of salts may include, but are not limited to, calcium carbonate, benzoic acid, magnesium oxide, sodium bicarbonate, sodium chloride, potassium chloride, calcium chloride, ammonium sulfate, and combinations thereof.

The fillers should have a size appropriate for the size of the filler-doped degradable component. The fillers can have a weight average diameter of 100 nm to 1 cm, alternatively 100 nm to 10 microns, alternatively 1 micron to 100 microns, alternatively 10 microns to 1 mm, alternatively 100 microns to 1 mm, alternatively 100 microns to 1 cm, or alternatively 1 mm to 1 cm. As used herein, the term "diameter" refers to the largest diameter of the particle. For example, a spherical particle would be the diameter of the sphere, and a cylindrical particle would be the length of the cylinder.

The fillers can be present in the filler-doped degradable component at an amount of 10 vol % to 80 vol %, alternatively 10 vol % to 50 vol %, alternatively 10 vol % to 25 vol %, alternatively 25 vol % to 50 vol %, alternatively 30 vol % to 60 vol %, alternatively 50 vol % to 80 vol %, alternatively 60 vol % to 80 vol % of the filler-doped degradable component. The amount of filler should be chosen to maintain sufficient integrity for the filler-doped degradable component during use of the degradable plug and to maximize filler concentration to minimize cost of the filler-doped degradable component and maximize degradability of the degradable plug.

The filler-doped degradable components useful in the present invention may be created in many ways. By way of nonlimiting example, filler-doped degradable components may be created by combining one or more fillers and one or more degradable materials (e.g., to create a polymer melt with filler dispersed therein or a molten metal with filler dispersed therein) and then formed into a desired three-dimensional shape (e.g., using a mold, by extruding, or by casting). The desired three-dimensional shape can be the shape of the filler-doped degradable component or a larger shape that is cut, shaved, machined, or the like to the shape of the filler-doped degradable component.

In another example, the filler-doped degradable components may be created by combining one or more fillers and one or more degradable adhesives into a desired three-dimensional shape referred to herein as a preform and then encapsulating that preform with one or more degradable materials (optionally including filler dispersed therein). For example, an encapsulating shell of the degradable material can be sprayed or layered onto the preform. In another example, the preform can be suspended or otherwise maintained within a mold that is filled with the degradable material to encase the preform. Once the preform is encased by any of the foregoing methods or other suitable methods, portions of the degradable material can be removed, if needed, to achieve the proper dimensions of the filler-doped degradable component.

The composition and thickness of the degradable material encapsulating shell as well as the wellbore conditions can regulate the rate at which the filler-doped degradable component degrades. The thickness of the encapsulating shell can be any suitable thickness (and variable around the preform) depending on the foregoing and the type of filler-doped degradable component. For example, a mandrel may have a thicker encapsulating shell than a mule shoe. Thicknesses of the encapsulating shell can range from about 5 mm to about 10 cm, or alternatively 5 mm to 1 cm. However, other thickness may be appropriate depending on the desired time frame for degradation of the encapsulating shell and the structural requirements of the type of filler-doped degradable component.

Degradable adhesives can degrade by any suitable mechanism. Hydrolysis is a preferred degradation mechanism. Examples of degradable adhesives include, but are not limited to, urethane-based adhesives, dentin adhesives, polyester adhesives, polysaccharide adhesives, and combinations thereof.

Components of a degradable plug that can include, but are not limited to, slips, cones, mule shoes, mandrels, sealing sleeves, components used in conjunction with sealing sheaths, body rings, expansion rings, slip bodies, swage seals, setting rings, and petal rings. A degradable plug can comprise one or more filler-doped degradable components. The following figures include examples of degradable plug and filler-doped degradable components including components produced from preforms.

Figure 1B:
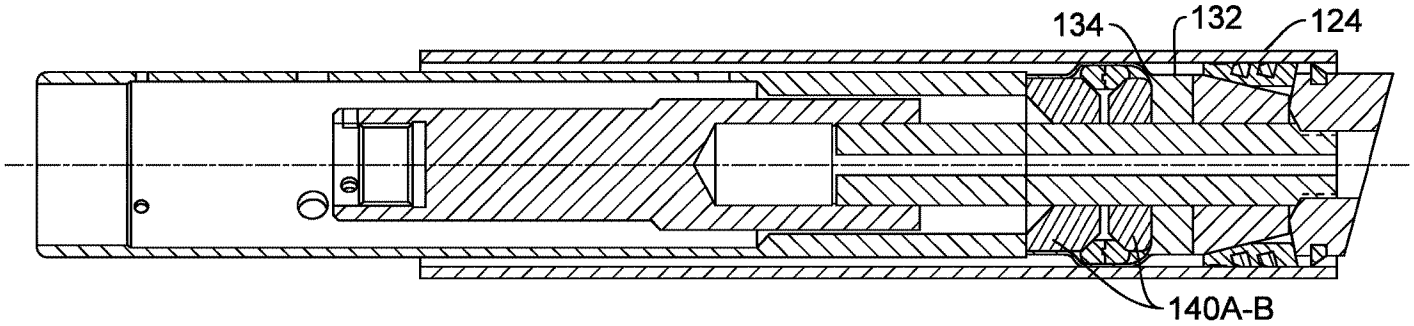
Figure 1C:
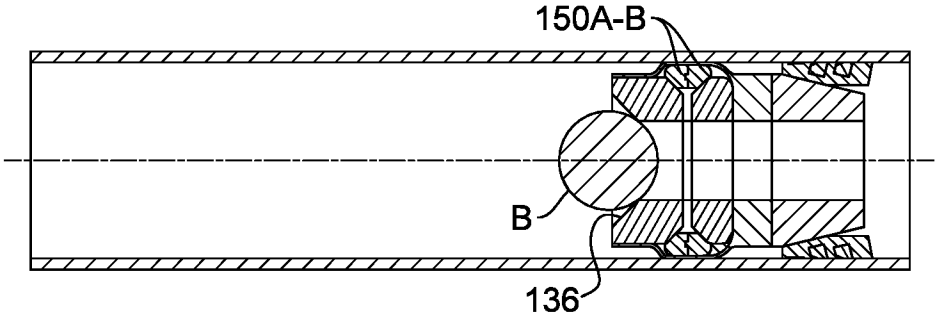
Figure 1D:
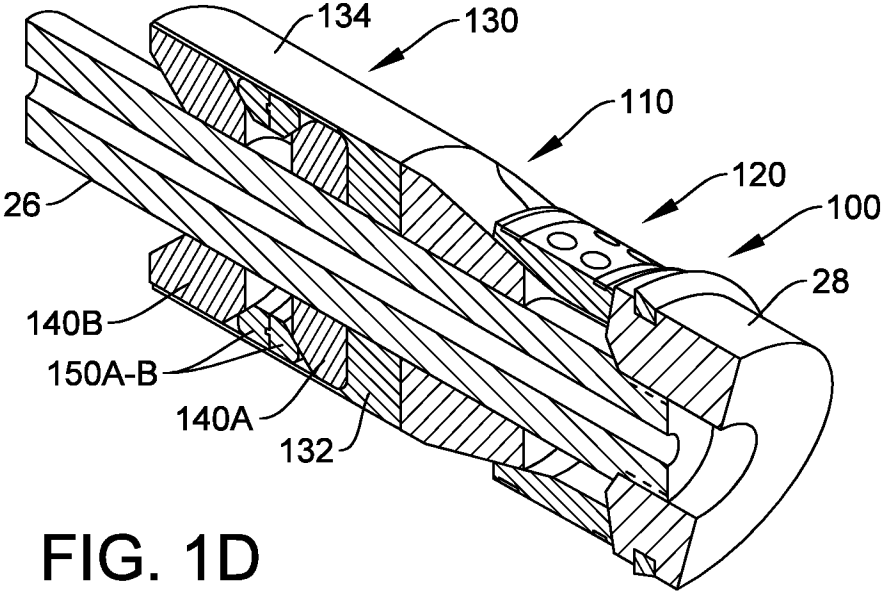
FIG. 1D illustrates a perspective view of the first degradable plug in cross-section.

FIGS. 1A-1C illustrate cross-sectional views of a first degradable plug 100 according to the present disclosure during stages of setting in tubing, such as cemented casing 10. FIG. 1D illustrates a perspective view of the first degradable plug 100 in cross-section. The plug 100 includes a cone 110, a slip 120, and a seal element (having a sealing sleeve or sheath 130, body rings 140A-B, and expansion element or rings 150A-B).

For run-in as shown in FIG. 1A, a running tool 20 has an outer setting sleeve 22 disposed about an inner setting tool 24. This running tool 20 can be run alone on wireline or other conveyance or can be run with a perforating gun assembly on wireline or the like. The components 110, 120, 130, 140A-B, and 150A-B of the disclosed plug 100 fit on a run-in mandrel 26 that is connected to the inner tool 24. A mule shoe 28 is affixed on the end of the run-in mandrel 26 to hold the plug 100 in place. A temporary connection, such as a shearable thread 27, holds the mule shoe 28 on the run-in mandrel 26 until setting procedures are complete, as discussed later. Other temporary connections could be used to hold the mule shoe 28 on the mandrel 26.

The cone 110 of the plug 100 has an incline 112 against which the slip 120 can wedge. The other end of the slip 120 abuts against the mule shoe 28, which is used to push the slip 120 on the incline 112 during setting.

The sealing sleeve 130 has a lip 132 of increased thickness and width that fits around the run-in mandrel 26 like a ring and abuts against the cone 110. A thin sheath 134 of the sealing sleeve 130 extends from this lip 132 so that the lip 132 acts as an anchor for the thin sheath 134 as it runs along the outside of the plug 100. Disposed within this sheath 134 around the run-in mandrel 26, the plug 100 has its body rings 140A-B and expansion rings 150A-B. The body rings 140A-B sandwich the expansion rings 150A-B, and each abutting corner of these rings 140, 150 can have angled edges.

Figures 1, 1E, 2:
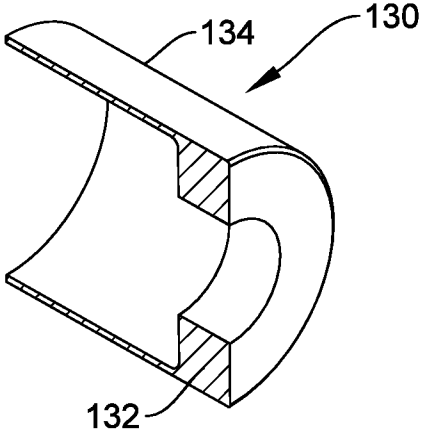
FIGS. 1E-1 and 1E-2 illustrate details of the setting sleeve, body rings, and expansion element or rings for the disclosed plug.
Figures 1, 1E:
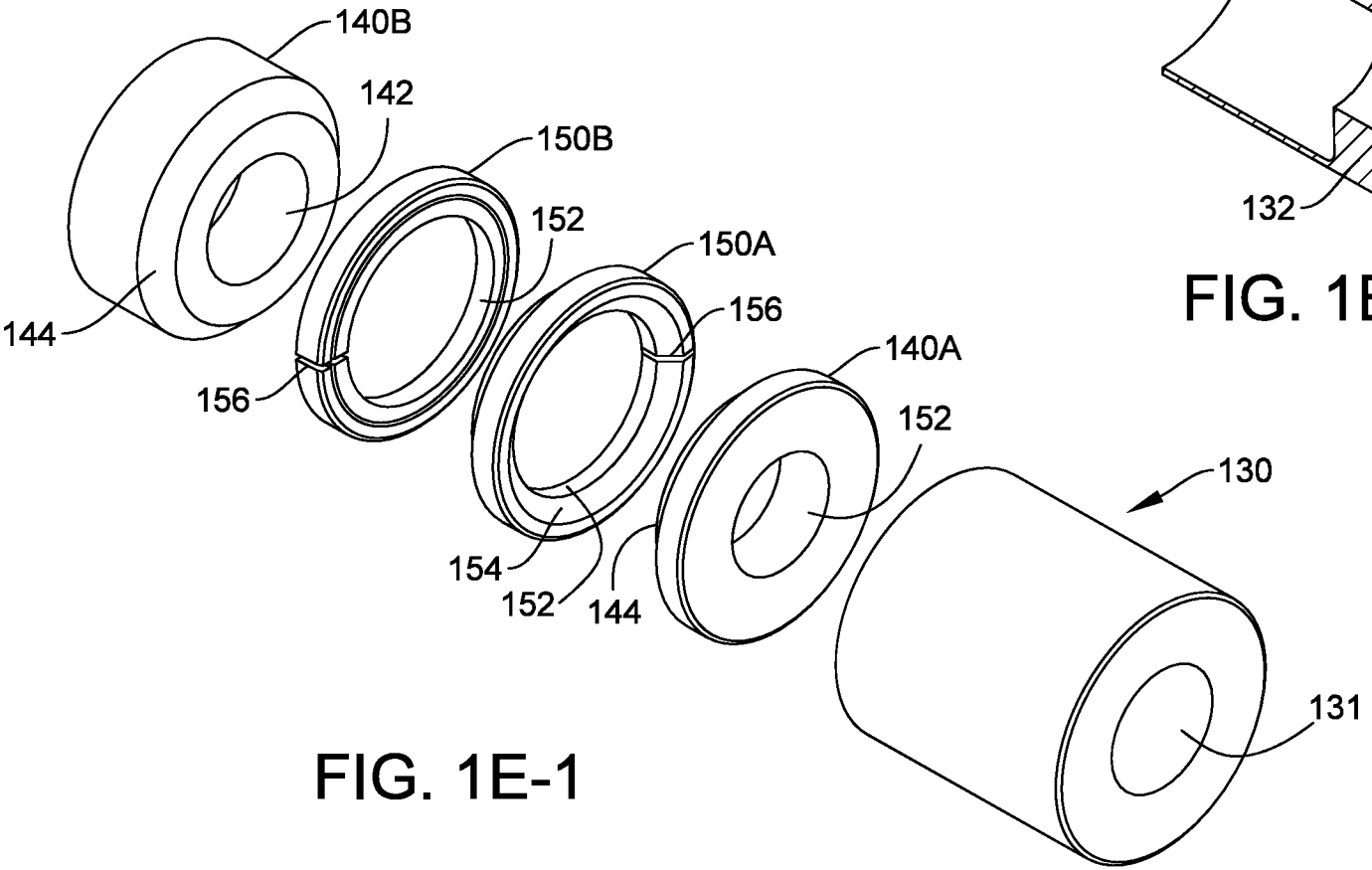
Figures 1, 1F, 2:
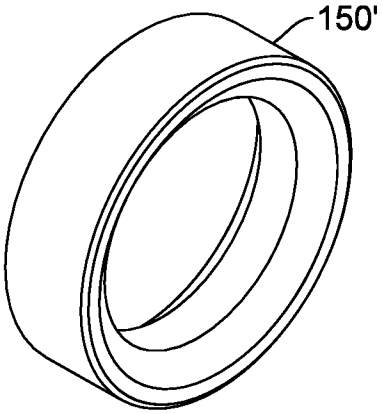

FIGS. 1E-1 and 1E-2 illustrate details of the sealing sleeve 130, the body rings 140A-B, and the expansion element or rings 150A-B for the disclosed plug 100. The sleeve 130 and rings 140A-B, 150A-B each have central passages 131, 142, 152 for fitting on a mandrel (not shown). The rings 140A-B, 150A-B have angled edges 144, 154. As shown, the expansion rings 150A-B preferably includes two adjacent split C-rings that can slide relative to one another as they expand outward. The splits 156 in these rings 150A-C are misaligned so that the two split rings 150A-B together form a complete ring.

Figures 1, 1F, 2, 3:
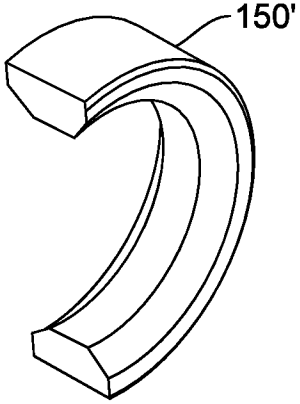
Figures 1, 1F:
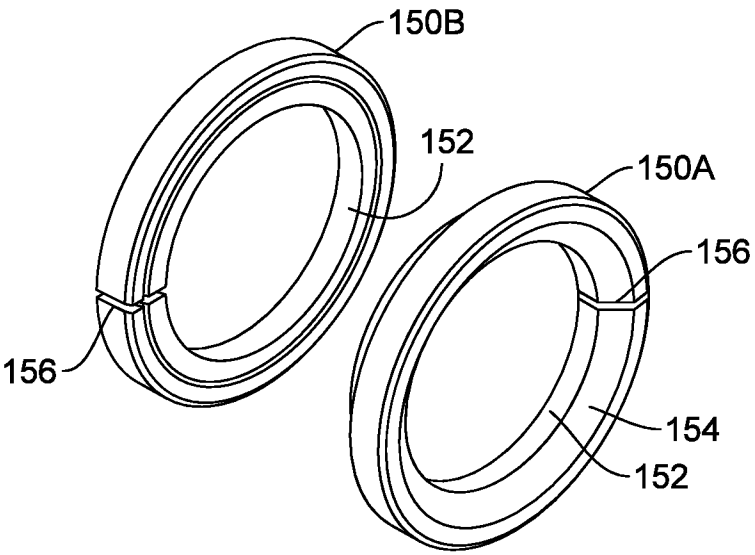

FIGS. 1F-1, 1F-2, and 1F-3 illustrate alternative details of the expansion element or rings for the disclosed plug. Instead of the split rings 150A-C discussed above and shown in FIG. 1F-1, the expansion element can be a ring 150' of elastomer or other deformable material, as illustrated in FIGS. 1F-2 and 1F-3.

During run-in as shown in FIG. 1A, the plug 100 is held on the run-in mandrel 26 uncompressed. The running tool 20 is coupled to an actuator (not shown) used for activating the setting tool 20 and setting the plug 100. During activation, the setting sleeve 22 pushes against the body ring 140B, while the inner setting tool 24 pulls the run-in mandrel 26 in the opposite direction. As a result, the mule shoe 28 concurrently pushes against the slip 120, and the components of the plug 100 are compressed.

As shown in FIG. 1B, the slip 120 is pushed up the incline 112 and wedged against the inside wall 12 of the casing 10. The slip 120 can be a continuous cylindrical shape with separable splits, cuts, or the like formed therein, can be independent segments, or can have some other known configuration. At the same time, the body rings 140A-B are brought together, and the expansion rings 150A-B are forced outward toward the surrounding casing 10. The sheath 134 bulges outward by being deformed by the expansion ring 150A-B and forms a metal-to-metal seal with the inner casing wall 12.

Eventually, the setting force shears the mule shoe 28 free from the run-in mandrel 26 so that the setting tool 20 is released from the plug 100, which is now set in the casing 10. The mule shoe 28 can fall downhole where, if it is a filler-doped degradable component, it can dissolve. The setting tool 20 can be retracted from the casing 20. The plug 100 is now ready for use.

As shown in FIG. 1C, the plug 100 remains set with the seal element expanded. Then, a ball B or other plugging element can be deployed to the plug 100 to seat against the seating surface 136 of the body ring 140B. Pressure for a fracture treatment can be applied against the plug 100 with the seated ball B, which prevents the treatment from passing to zones further downhole. Although a ball B is shown and referenced throughout this disclosure, other types of plugging elements B can be used, including darts, cones, and the like known and used in the art. Therefore, reference to a ball B as used herein refers equally to any other acceptable plugging element. The pressure against the seated ball B on the set plug 100 can further act to seal the plug's seal element against the casing with the slip 120 helping anchor the plug 100 in place.

In this example, one or more of the cone 110, slip 120, sealing sleeve 130, body rings 140A-B, expansion rings 150A-B, mule shoe 28, thin sheath 134, and/or ball B can be a filler-doped degradable component. The cone 110, slip 120, sealing sleeve 130, body rings 140A-B, expansion rings 150A-B, mule shoe 28, and/or thin sheath 134 can be formed using a degradable metal. Preferably, the slip 120, sealing sleeve 130, expansion rings 150A-B, and/or ball B are formed using degradable polymers.

Figure 1H:
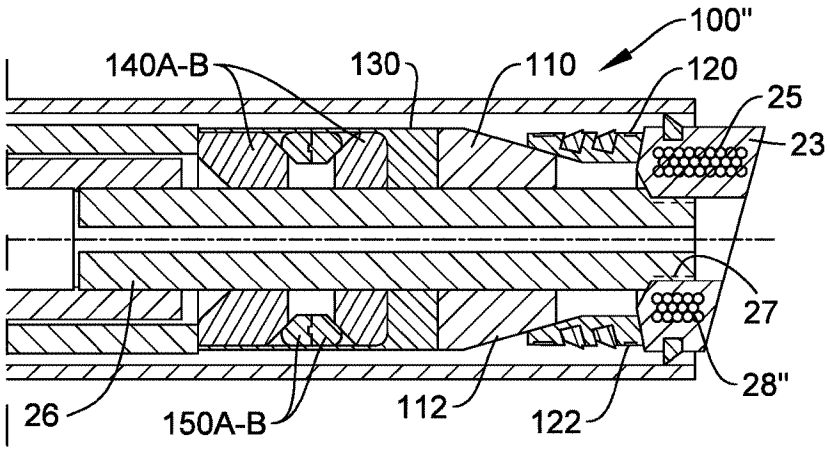
FIGS. 1G-1J illustrate different examples of the first degradable plug with different filler-doped degradable components.
Figure 1G:
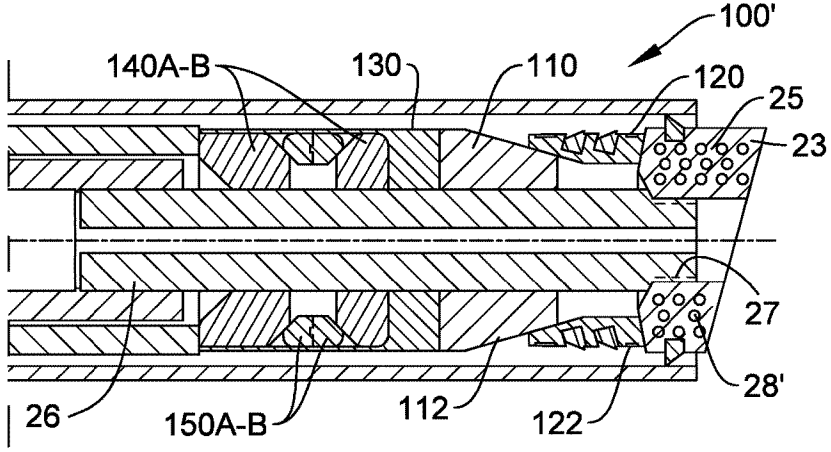

FIG. 1G illustrates a degradable plug 100' that is an embodiment of degradable plug 100 of FIGS. 1A-F where the mule shoe 28' is a filler-doped degradable component. In this example, a filler 25 is dispersed in a degradable material 23.

FIG. 1H illustrates a degradable plug 100" that is an embodiment of degradable plug 100 of FIGS. 1A-F where the mule shoe 28" is a filler-doped degradable component. In this example, the mule shoe 28" is preform of filler 25 adhered together and encased with a degradable material 23.

Figure 1J:
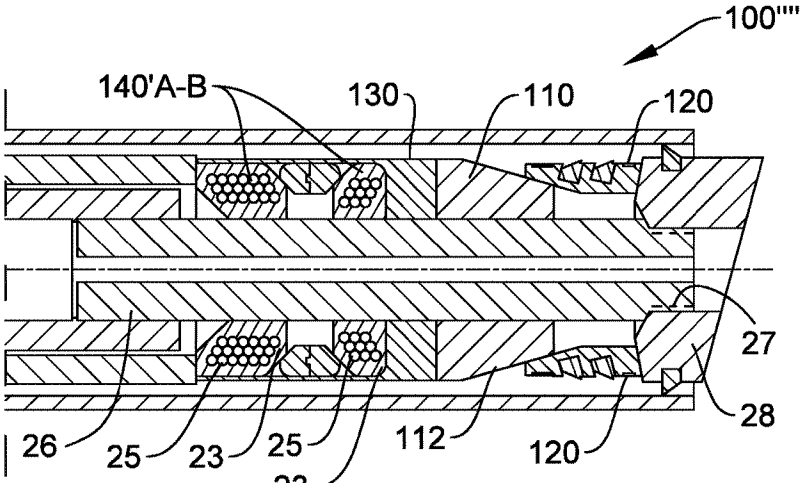
Figure 1I:
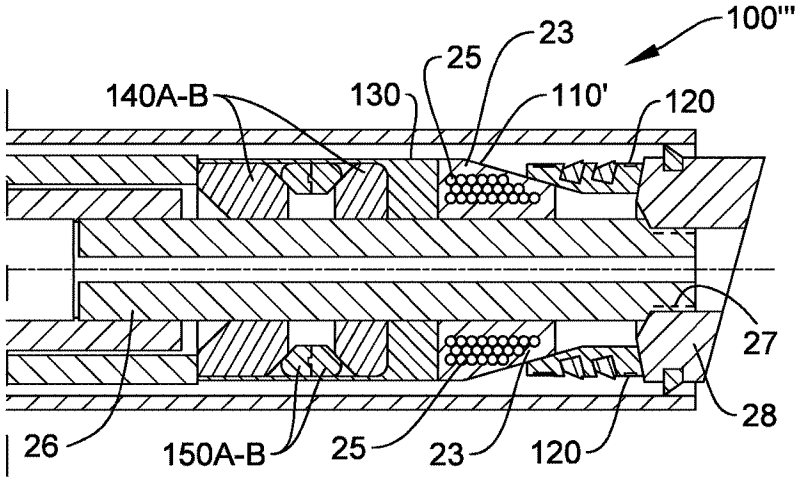

FIG. 1I illustrates a degradable plug 100*m* that is an embodiment of degradable plug 100 of FIGS. 1A-F where the cone 110'" is a filler-doped degradable component. In this example, the cone 110' is preform of filler 25 adhered together and encased with a degradable material 23.

FIG. 1J illustrates a degradable plug 100"" that is an embodiment of degradable plug 100 of FIGS. 1A-F where the body rings 140'A-B are filler-doped degradable components. In this example, the body rings 140'A-B re preform of filler 25 adhered together and encased with a degradable material 23.

Other components of the degradable plug 100 of FIGS. 1A-F can be filler-doped degradable components either as filler dispersed in degradable material or as a preform encased with degradable material. Combinations of filler dispersed in degradable material degradable components and preform encased with degradable material degradable components can be used in a single degradable plug.

Figure 2A:
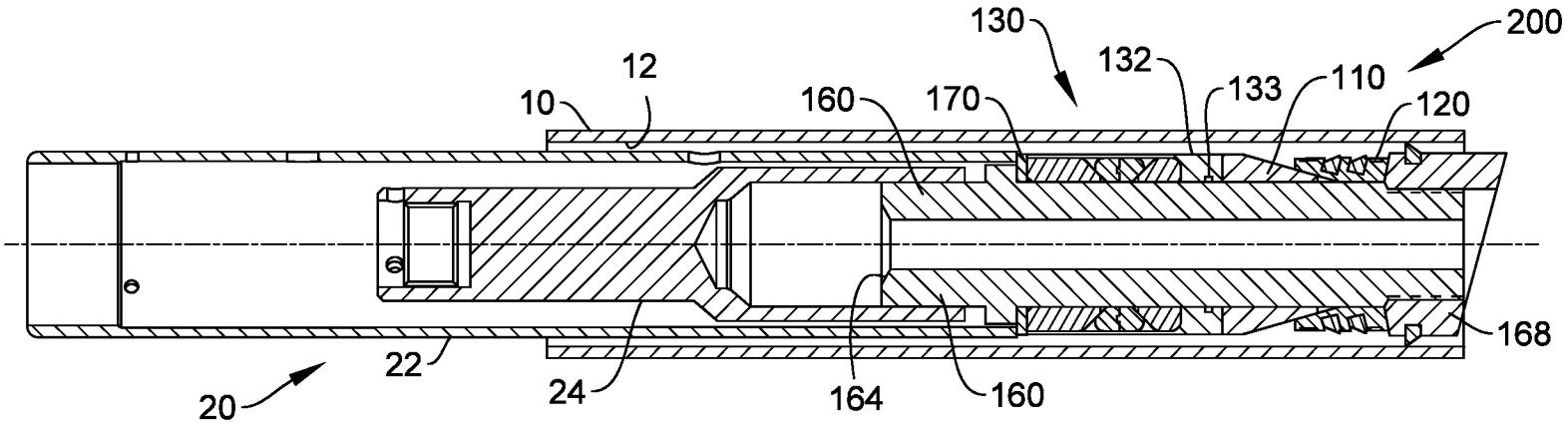
FIGS. 2A-2C illustrate cross-sectional views of a second degradable plug with a mandrel according to the present disclosure during stages of setting in tubing.
Figure 2B:
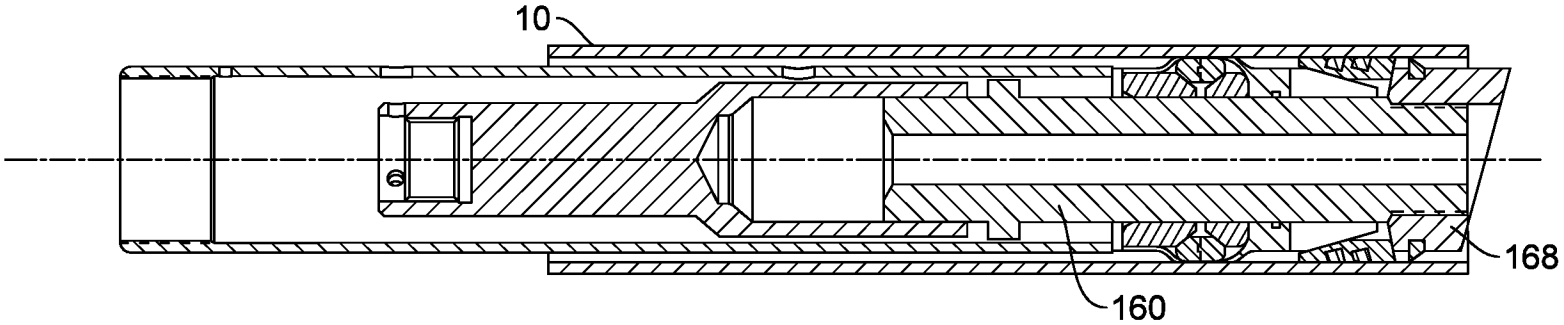
Figure 2C:
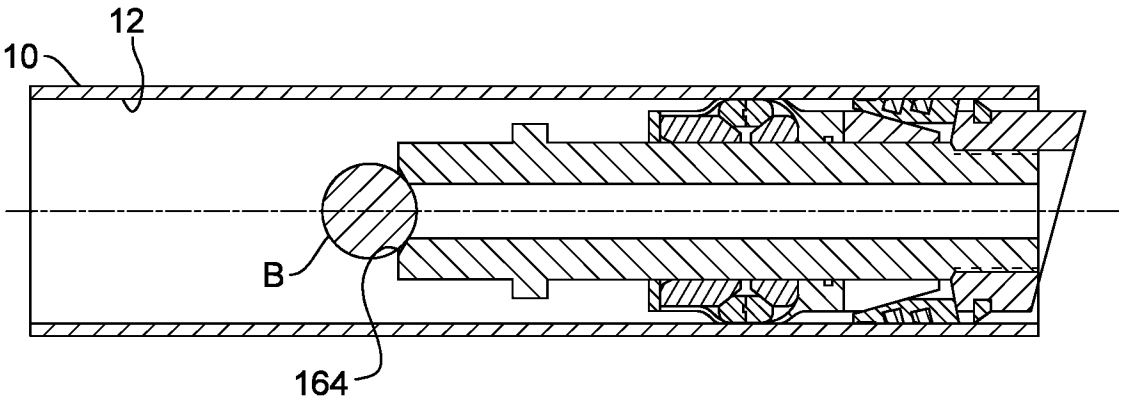
Figure 2D:
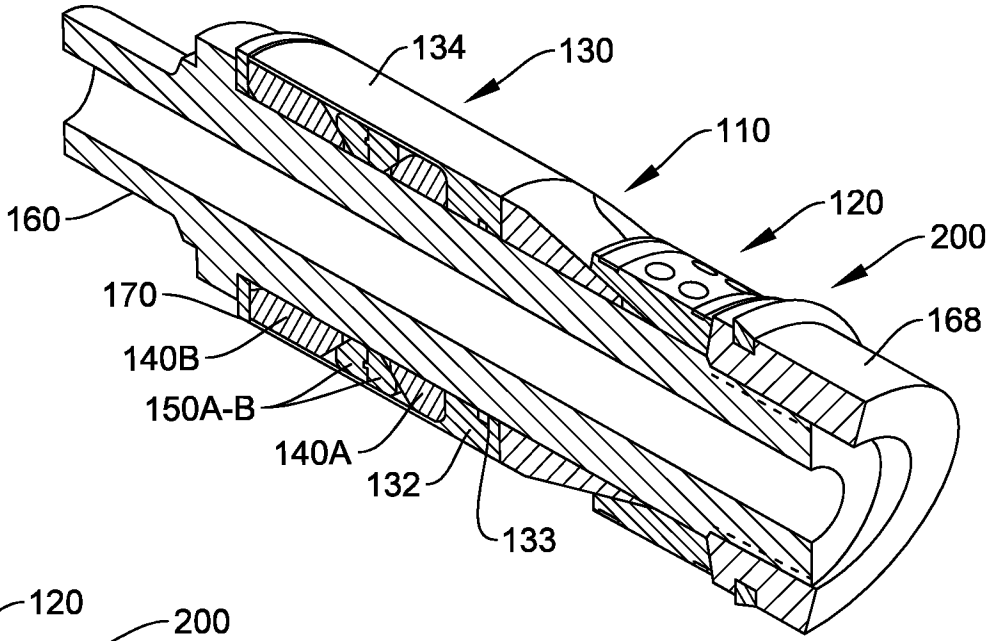
FIGS. 2D-2E illustrate perspective views of the second degradable plug in cross-section and in full.
Figure 2E:
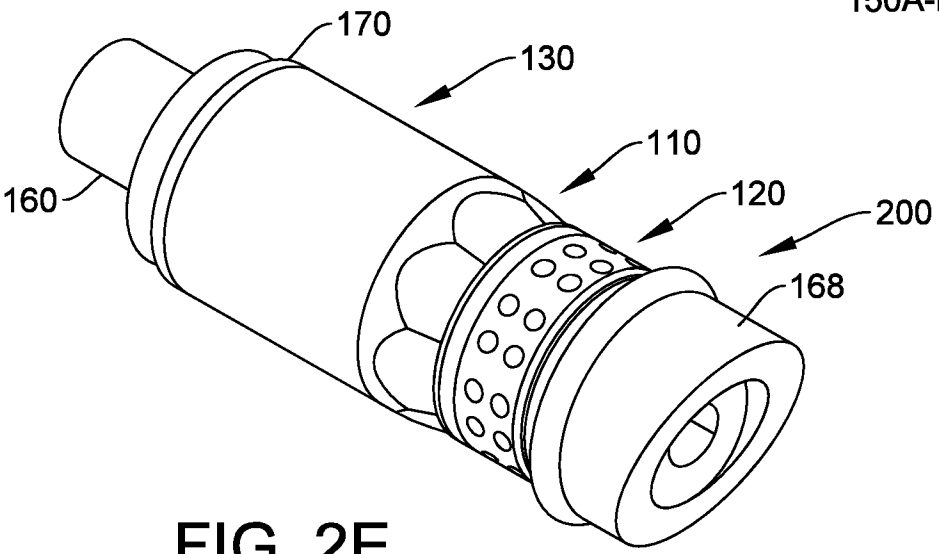

FIGS. 2A-2C illustrate cross-sectional views of a second degradable plug 200 according to the present disclosure during stages of setting in casing 10, and FIG. 2D-2E illustrate perspective views of the second degradable plug 200 in cross-section and in full. This plug 200 is similar to plug 200 disclosed above with reference to FIGS. 1A-1D so that like reference numerals are used for similar components. In contrast to the previous embodiment, this plug 200 includes a mandrel 160 that remains with the plug 200 after setting. Further, plug 200 includes a mule shoe 168 affixed to the mandrel's distal end.

On this plug 200, the mandrel 160 is attached to the inner setting tool 24 of the running tool 20 with a temporary connection, such as a shearable or releasable thread 164. With the setting forces applied, the running tool 20 can eventually shear free of the mandrel 160 which remains as part of the plug 200.

In other differences, the plug 200 includes one or more seals on the ring components and the mandrel 160 to prevent fluid bypass. For example, the lip 132 of the sealing sleeve 130 can have an O-ring seal 133 on its inner diameter to seal against the mandrel 160. As another difference, a contact ring 170 can be disposed on the mandrel 160 against which the setting sleeve 22 presses during setting procedures.

In this example, one or more of the cone 110, slip 120, sealing sleeve 130, body rings 140A-B, expansion rings 150A-B, mule shoe 28, thin sheath 134, mandrel 160, and/or ball B can be a filler-doped degradable component. The cone 110, slip 120, sealing sleeve 130, body rings 140A-B, expansion rings 150A-B, mule shoe 168, thin sheath 134, and/or mandrel 160 can be formed using a degradable metal. Preferably, the slip 120, sealing sleeve 130, expansion rings 150A-B, and/or ball B are formed using degradable polymers.

Figure 2F:
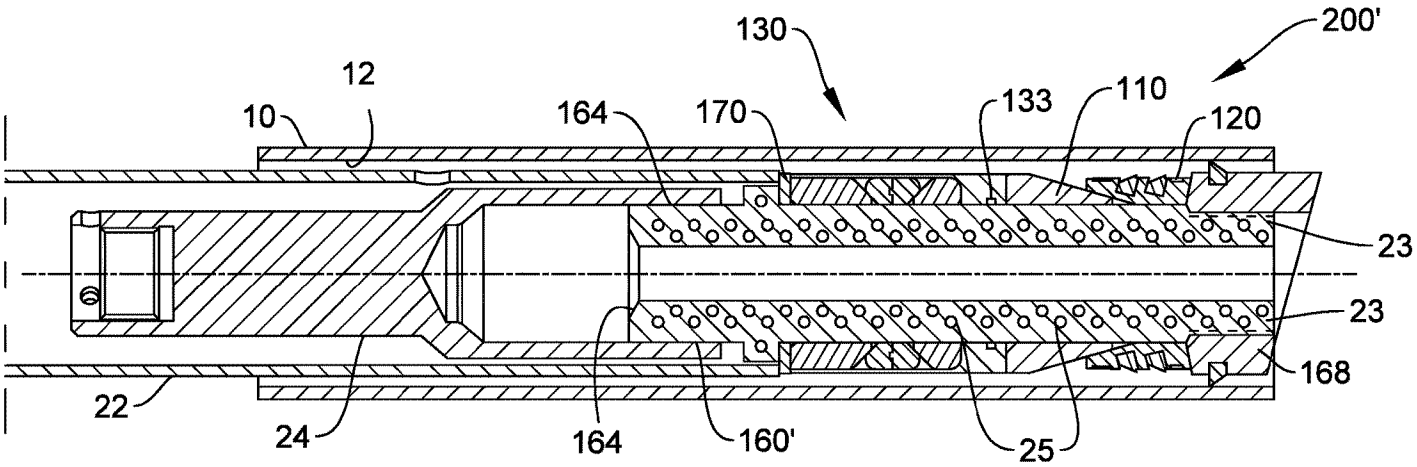
FIGS. 2F-2G illustrate different examples of the second degradable plug with different filler-doped degradable components.

FIG. 2F illustrates a degradable plug 200' that is an embodiment of degradable plug 200 of FIGS. 2A-E where the mandrel 160' is a filler-doped degradable component. In this example, a filler 25 is dispersed in a degradable material 23.

Figure 2G:
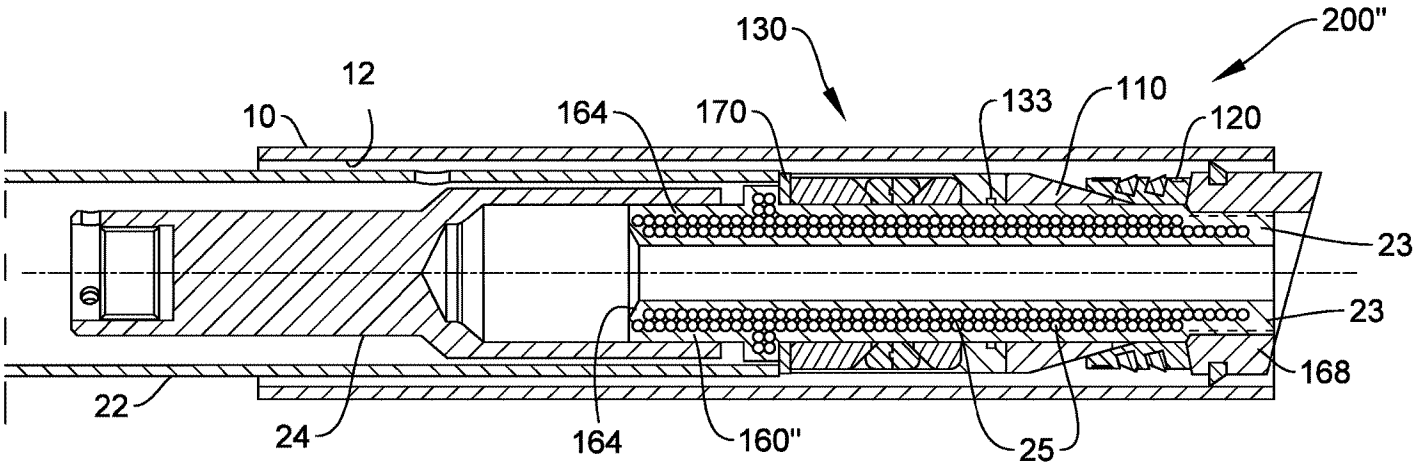

FIG. 2G illustrates a degradable plug 200" that is an embodiment of degradable plug 200 of FIGS. 2A-E where the mandrel 160" is a filler-doped degradable component. In this example, the mandrel 160" is preform of filler 25 adhered together and encased with a degradable material 23.

Other components of the degradable plug 200 of FIGS. 2A-E can be filler-doped degradable components either as filler dispersed in degradable material or as a preform encased with degradable material. Combinations of filler dispersed in degradable material degradable components and preform encased with degradable material degradable components can be used in a single degradable plug.

Figure 3A:
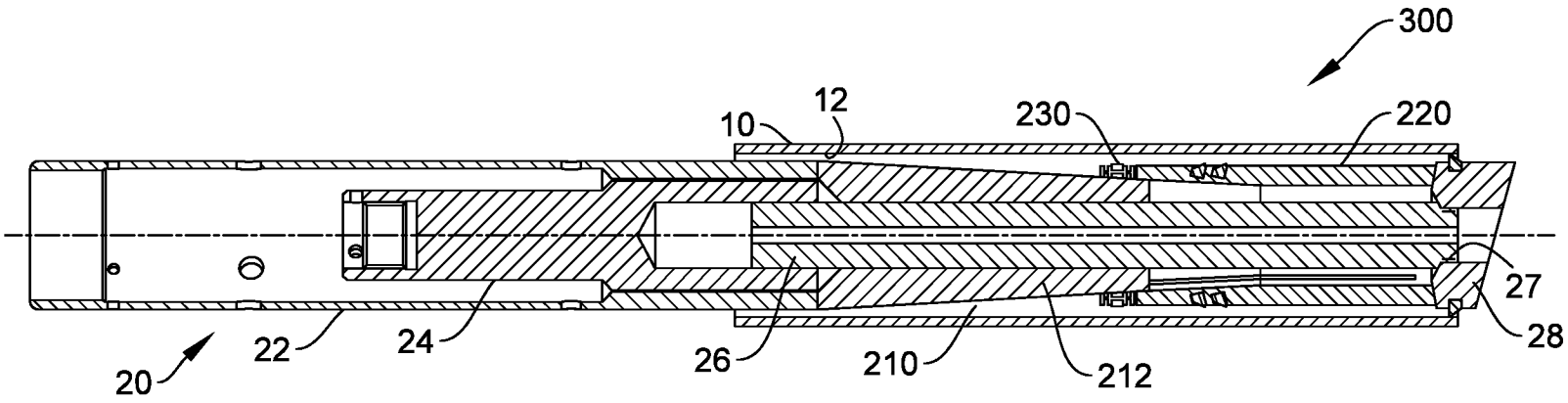
FIGS. 3A-3C illustrate cross-sectional views of a third degradable plug according to the present disclosure during stages of setting in tubing.
Figure 3B:
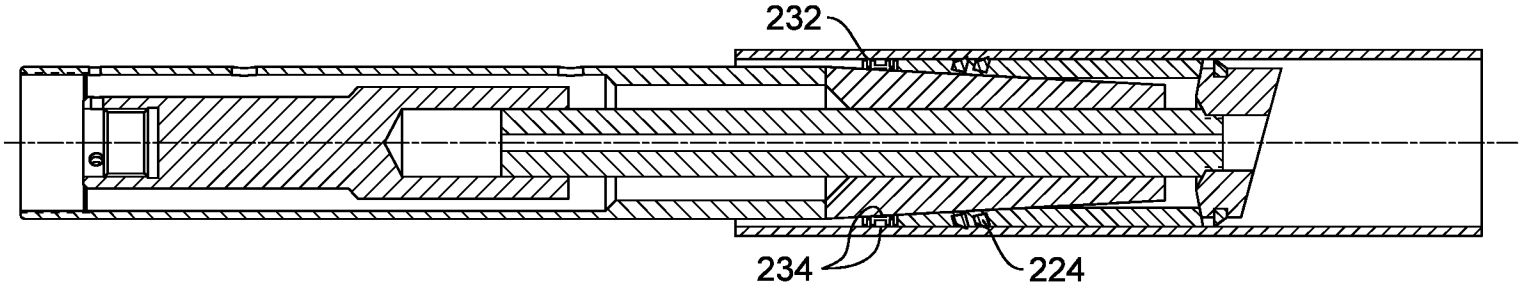
Figure 3C:
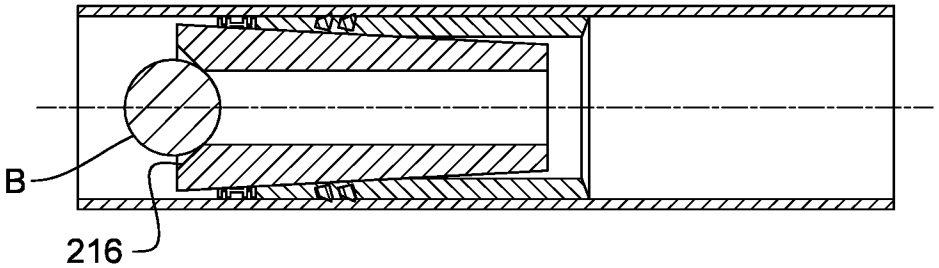
Figure 3D:
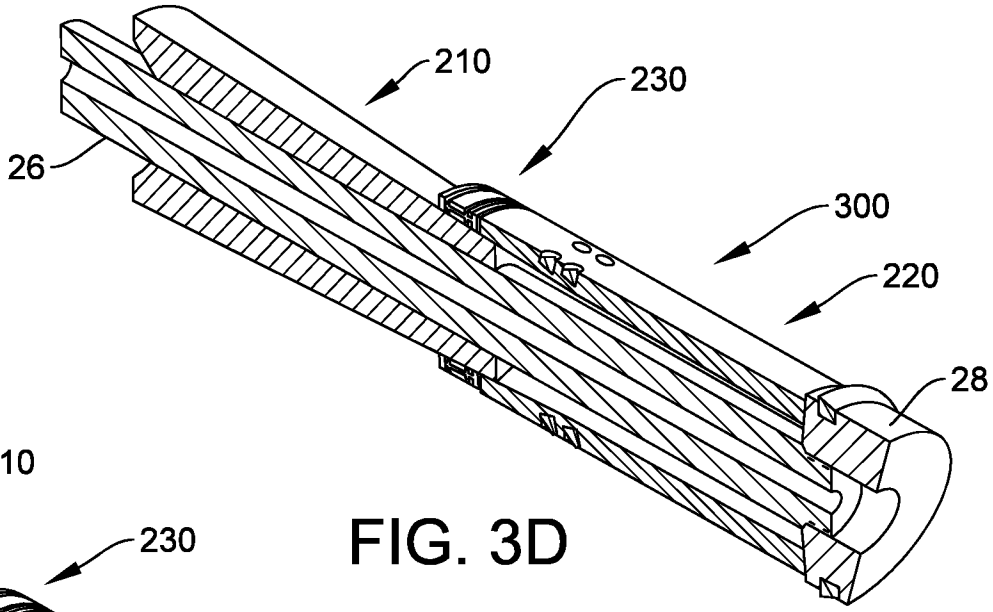
FIGS. 3D-3E illustrate perspective views of the third degradable plug in cross-section and in full.
Figure 3E:
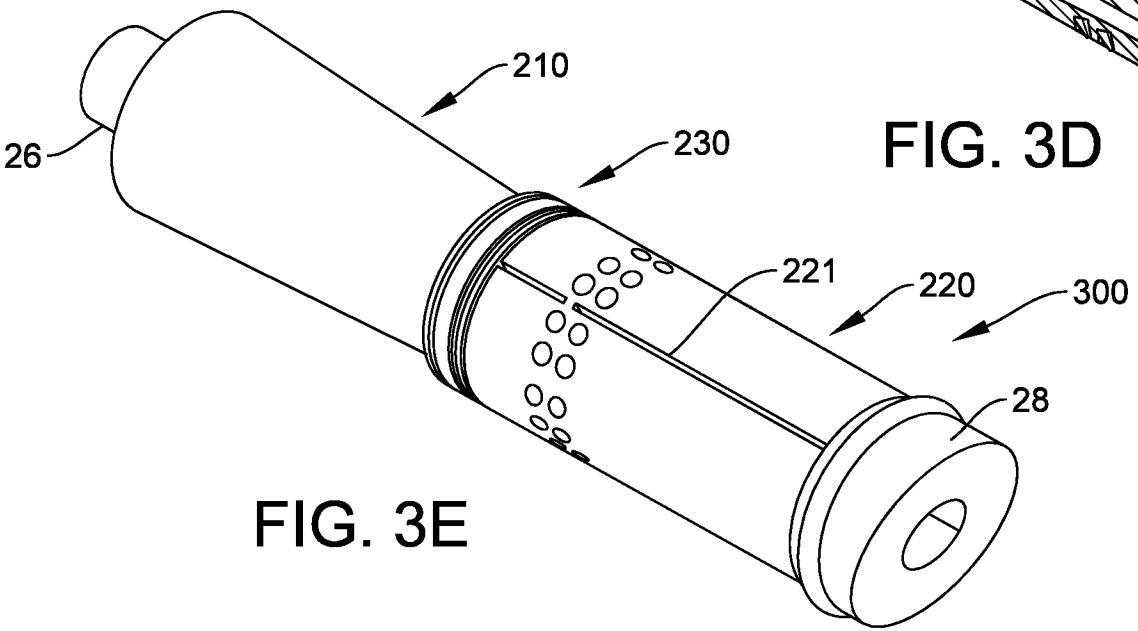

FIGS. 3A-3C illustrate cross-sectional views of a third degradable plug 300 according to the present disclosure during stages of setting in tubing, and FIGS. 3D-3E illustrate perspective views of the third degradable plug 300 in cross-section and in full. The plug 300 includes a wedge body or cone 210, a slip body or slip 220, and a seal element or swage seal 230.

For run-in as shown in FIG. 3A, a running tool 20 has an outer setting sleeve 22 disposed about an inner setting tool 24. The components 210, 220, and 230 of the plug 300 fit on a run-in mandrel 26, which can be composed of steel and is connected to the inner tool 24. Again, this run-in mandrel 26 can be removed once the plug 300 is set as discussed below.

A temporary connection, such as a shearable thread 27, hold the mule shoe 28 on the run-in mandrel 26 until setting procedures are complete, as discussed later.

The wedge body 210 of the plug 300 has the form of a cone having an incline 212 against which the slip body 220 can wedge. The other end of the slip body 220 abuts against the mule shoe 28, which is used to push the slip body 220 on the incline 212 during setting.

The swage seal 230 is disposed on the incline 212 of the wedge body 210. Internal and external seal members 234 can be disposed about the inner and outer dimensions of the ring body 232. These seal members 234 can be elastomer, soft metal, polymer, and the like.

During run-in as shown in FIG. 3A, the plug 300 is held on the run-in mandrel 26 uncompressed. The running tool 20 is coupled to an actuator (not shown) used for activating the setting tool 20 and setting the plug 300. During activation, the setting sleeve 22 pushes against the wedge body 210, while the inner setting tool 24 pulls the run-in mandrel 26 in the opposite direction. As a result, the mule shoe 28 concurrently pushes against the slip body 220, and the components of the plug 300 are compressed.

As shown in FIG. 3B, the slip body 220 is pushed up the incline 212 and wedged against the inside wall 12 of the casing 10. At the same time, the inserts 224 in the slip body 220 bite into the casing wall 12, and the swage seal 230 is expanded outward toward the surrounding casing 10. As shown in FIG. 3E, the slip body 220 can have one or more slits 221 (i.e., divisions, cuts, or the like) that make the body 220 separable or expandable into one or more segments. For example, the slip body 220 can have one slit 221 so that the body 220 can expand outward as a partial cylinder when wedged by the wedged body 210. Alternatively, the slip body 220 can have more slits 221 so it can separate into various segments.

Eventually, the setting force shears the mule shoe 28 free from the run-in mandrel 26 so that the setting tool 20 is released from the plug 300, which is now set in the casing 10. The mule shoe 28 can fall downhole where it can, if it is a filler-doped degradable component, dissolve. The setting tool 20 can be retracted from the casing 10. The plug 300 is now ready for use. As shown in FIG. 3C, a ball B or the like can be deployed to the plug 300 to seat against the seating surface 216 of the wedge body 210. Pressure for a fracture treatment can be applied against the plug 300 with the seated ball B, which prevents the treatment from passing to zones further downhole. Pressure against the seated ball B can tend to further wedge the plug 300. This may be true not only for this plug 300, but the other plugs disclosed herein.

In this example, one or more of the wedge body 210, a slip body 220, swage seal 230, mule shoe 28, seal members 234, and/or ball B can be a filler-doped degradable component. The wedge body 210, a slip body 220, swage seal 230, mule shoe 28, and/or seal members 234 can be formed using a degradable metal. Preferably, the wedge body 210, a slip body 220, mule shoe 28, seal members 234, and/or ball B are formed using degradable polymers.

Figure 4A:
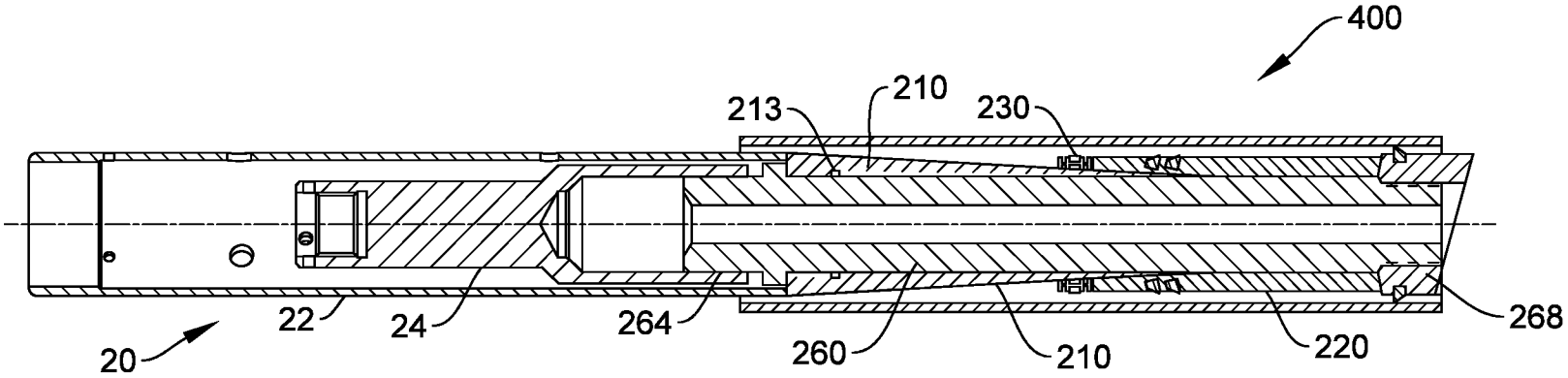
FIGS. 4A-4C illustrate cross-sectional views of a fourth degradable plug with a mandrel according to the present disclosure during stages of setting in tubing.
Figure 4B:
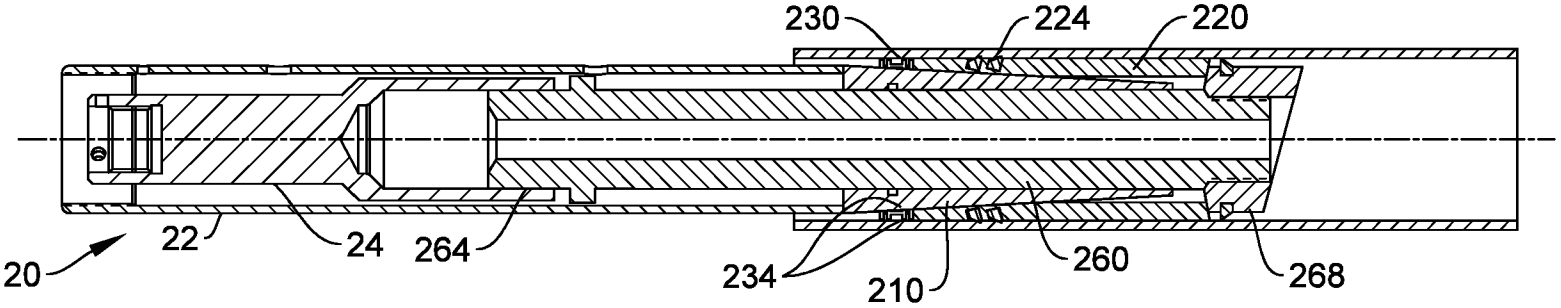
Figure 4C:
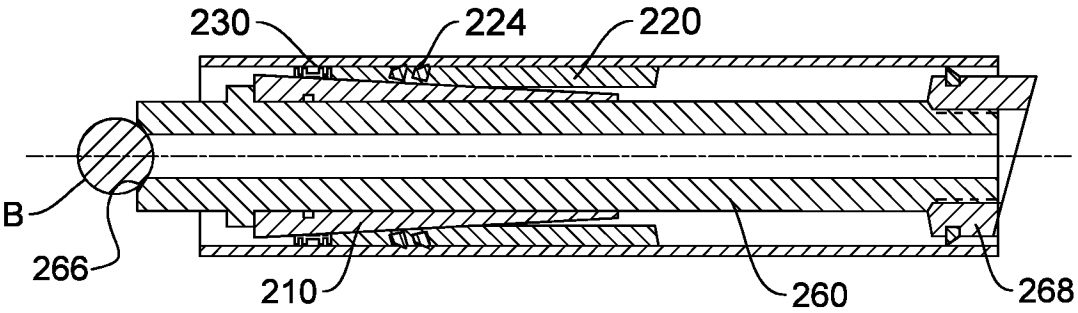
Figure 4D:
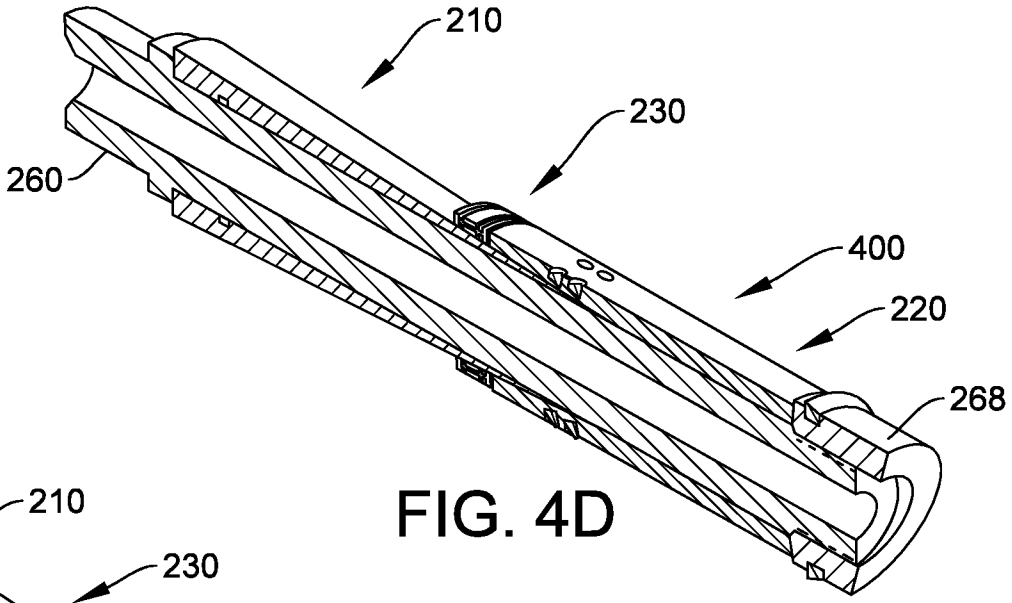
FIGS. 4D-4E illustrate perspective views of the fourth degradable plug in cross-section and in full.
Figure 4E:
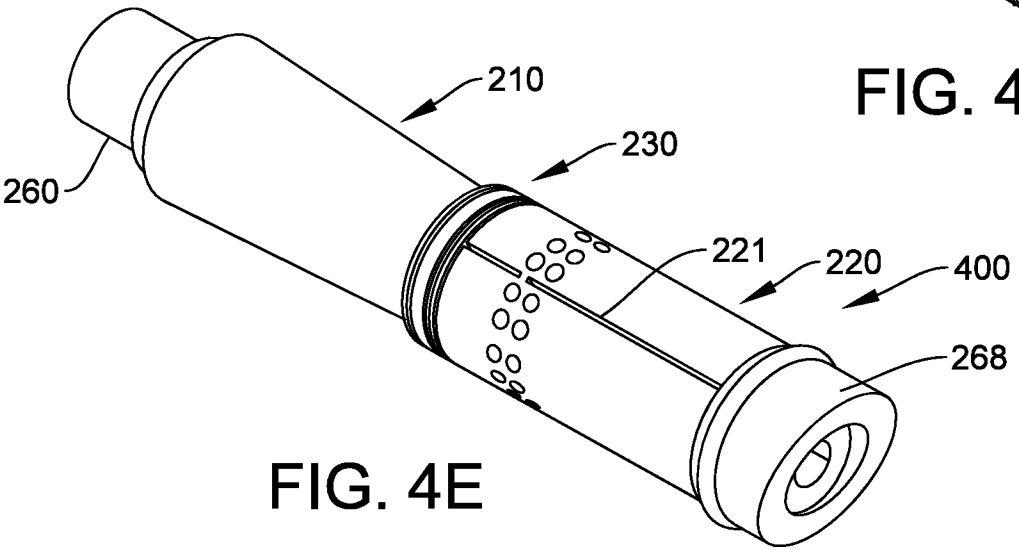

FIGS. 4A-4C illustrate cross-sectional views of a fourth degradable plug 400 with a mandrel 260 according to the present disclosure during stages of setting in tubing, and FIGS. 4D-4E illustrate perspective views of the fourth degradable plug 400 in cross-section and in full. This plug 400 is similar to that disclosed above with reference to FIGS. 3A-3E so that like reference numerals are used for similar components. In contrast to the previous embodiment, this plug 400 includes the mandrel 260 that remains with the plug 100 after setting and is connected to mule shoe 268.

With this plug 400, the mandrel 260 is attached to the inner setting tool 24 of the running tool 20 with a temporary connection, such as a shearable or releasable thread 264. With the setting forces, the running tool 20 shears free of the mandrel 260, which remains as part of the plug 400. In other differences, the plug 400 includes one or more seals on the ring components and the mandrel 260 to prevent fluid bypass. For example, the inside of the wedge body 210 can have an O-ring seal 213 on its inner diameter to seal against the mandrel 260.

In this example, one or more of the wedge body 210, a slip body 220, swage seal 230, mule shoe 268, seal members 234, mandrel 260, and/or ball B can be a filler-doped degradable component. The wedge body 210, a slip body 220, swage seal 230, mule shoe 268, seal members 234, mandrel 260, and/or ball B can be formed using a degradable metal. Preferably, the wedge body 210, a slip body 220, mule shoe 268, seal members 234, and/or mandrel 260 are formed using degradable polymers.

Figure 5A:
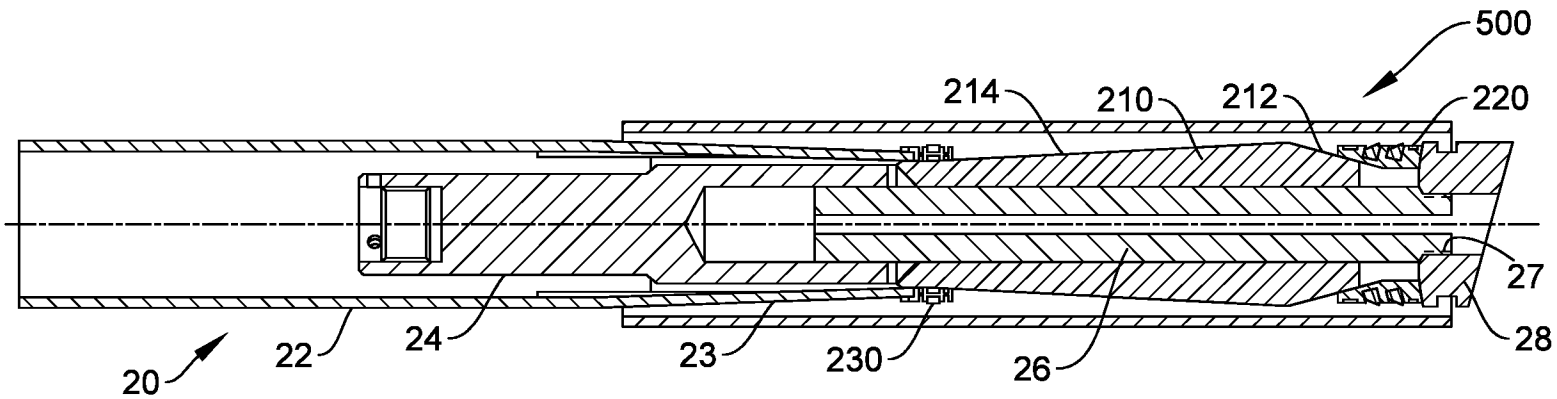
FIGS. 5A-5C and 5F illustrate cross-sectional views of a fifth degradable plug according to the present disclosure during stages of setting in tubing.
Figure 5B:
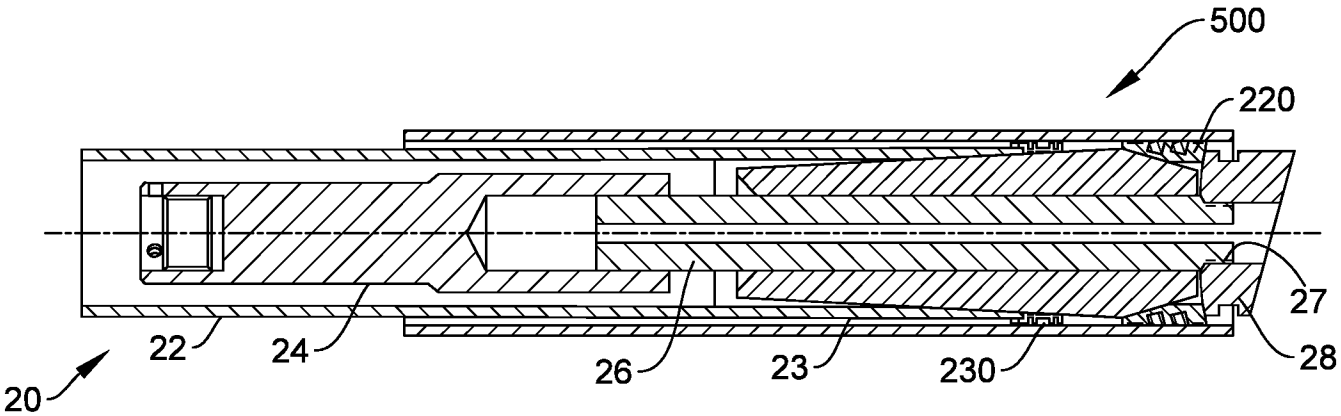
Figure 5C:
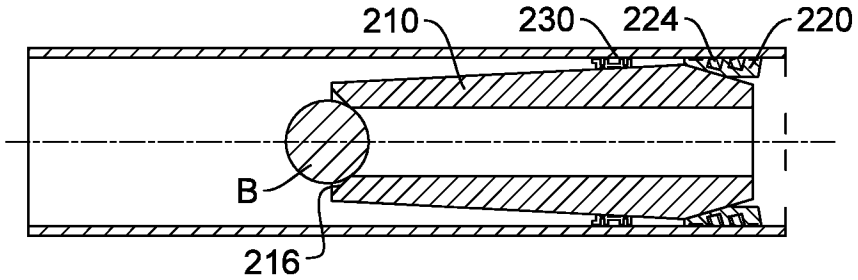
Figure 5D:
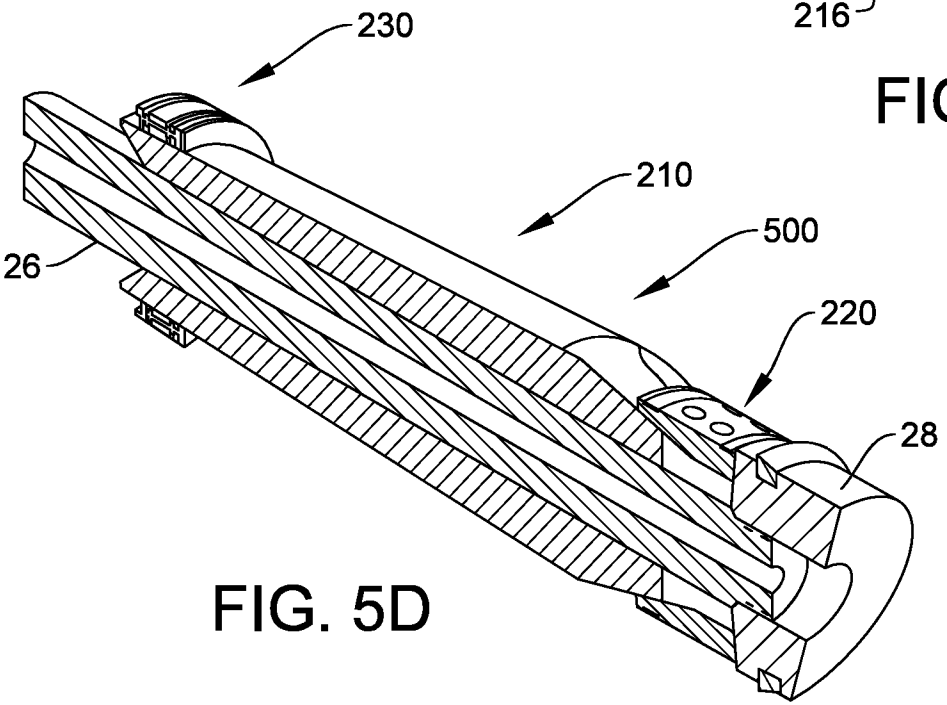
FIGS. 5D-5E illustrate perspective views of the fifth degradable plug in cross-section and in full.
Figure 5E:
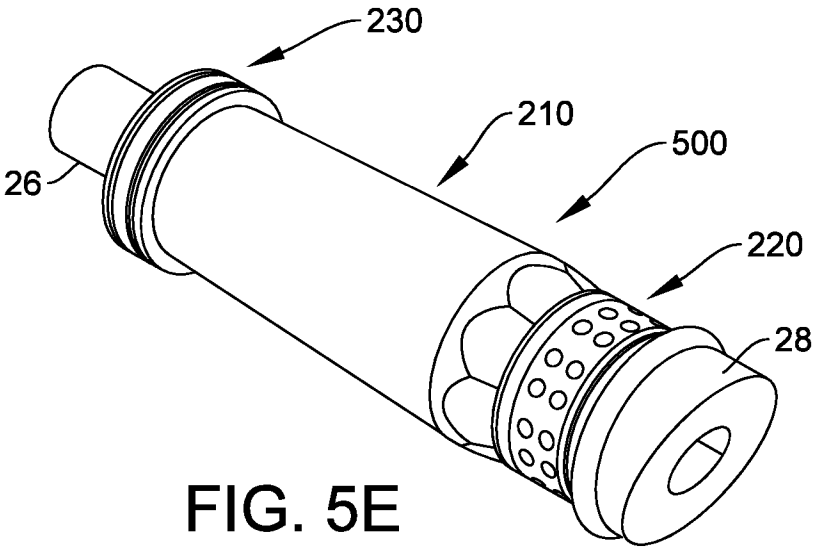
Figure 5F:
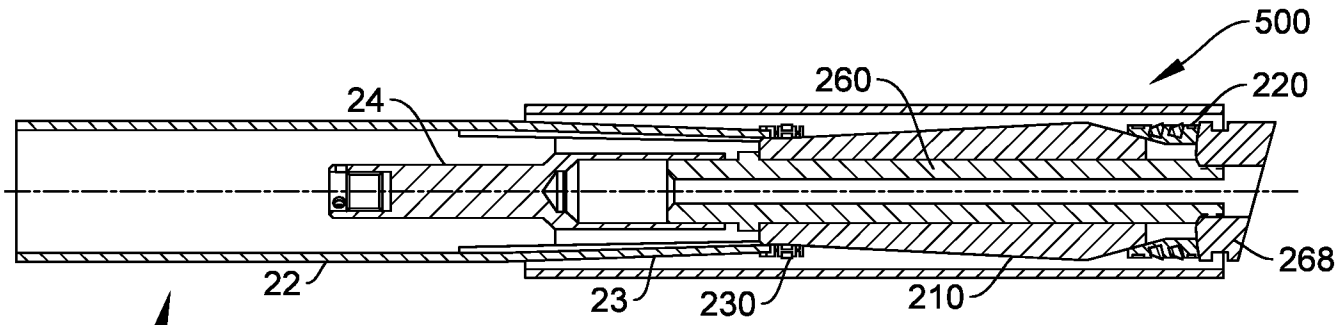

FIGS. 5A-5C illustrate cross-sectional views of a fifth degradable plug 500 according to the present disclosure during stages of setting in tubing, and FIGS. 5D-5E illustrate perspective views of the fifth degradable plug 500 in cross-section and in full. This plug 500 is similar to that disclosed above with reference to FIGS. 3A-3E so that like reference numerals are used for similar components. In contrast to the previous embodiment, the seal element or swage seal 230 is placed on an opposing incline 214 than the incline 212 for the slip body 220.

Additionally, setting procedures use a different setting tool 20 because the swage seal 230 is moved separately on the wedge body 210. In particular, the swage seal 230 is initially installed on the proximal end of the wedge body 210 near the connection of the setting tool 20. The setting sleeve 22 of the tool 20 has a collet 23 that engages the swage seal 230 to force the seal 230 along the incline 214 and to expand during this process.

It will be apparent based on the teachings of FIGS. 3A through 5E that yet an additional embodiment of the present disclosure can use the components of the plug 500 in FIGS. 5A-5E with a mandrel 260 as disclosed in the examples of FIGS. 4A-4E. Such an arrangement is briefly shown in FIG. 5F.

In this example, one or more of the wedge body 210, a slip body 220, swage seal 230, mule shoe 28, and/or ball B can be a filler-doped degradable component. The wedge body 210, a slip body 220, swage seal 230, and/or mule shoe 28 can be formed using a degradable metal. Preferably, the wedge body 210, a slip body 220, mule shoe 28, and/or ball B are formed using degradable polymers.

Based on the disclosure of the present application, one skilled in the art could produce different configurations of degradable plugs where at least one component is a filler-doped degradable component. Examples of other plug configurations where one or more filler-doped degradable components could be applied are in U.S. Pat. App. No. 2016/0376869, which is incorporated herein by reference.

Figure 6A:
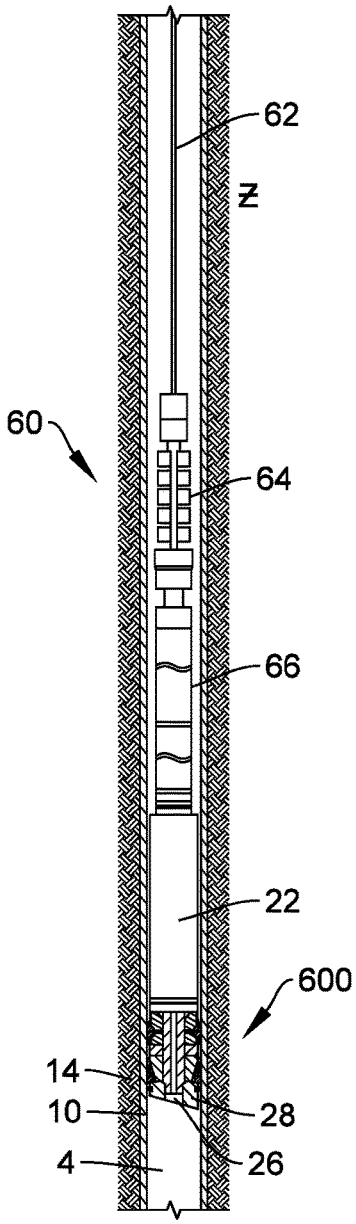
FIGS. 6A-6C illustrate steps of an example plug-and-pert operation with the disclosed degradable plugs.
Figure 6B:
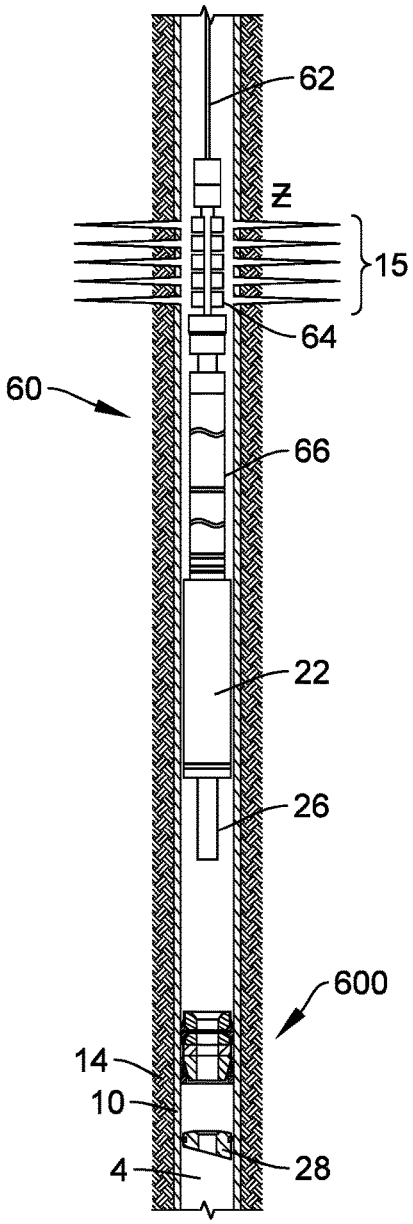
Figure 6C:
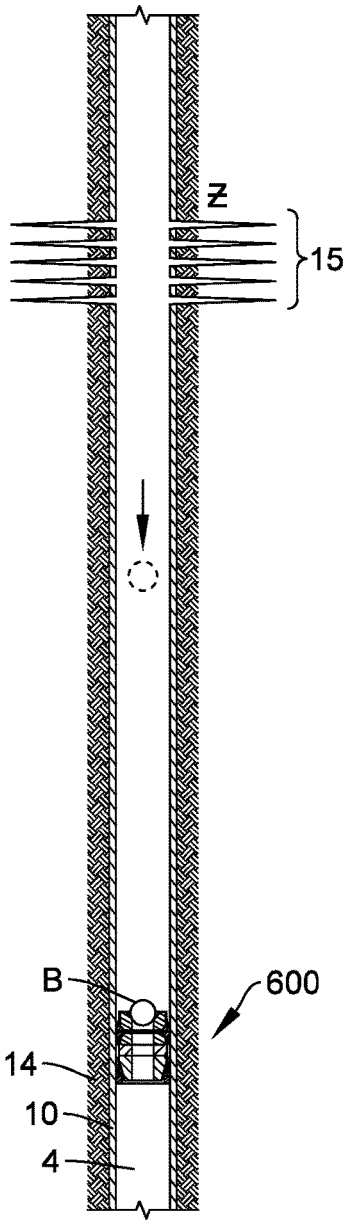

Having an understanding of at least some of the various degradable plugs disclosed herein that comprise one or more filler-doped degradable components, FIGS. 6A-6C illustrate an example of a plug-and-pert operation that can use the disclosed degradable plugs. Such a plug-and-pert operation can be used for fracturing zones of a formation. An assembly 60 is deployed into the wellbore 4 using a wireline 62. Assistance may be provided from a fracture pump (not shown) that pumps displacement fluid (not shown) just before the assembly 60 has been inserted into the wellbore 4. Pumping of the displacement fluid may increase pressure in the inner casing bore. If this is the first run into the casing 10, pumping of the fluid can also create a differential sufficient to open a toe sleeve (not shown) of the inner casing string. Once the toe sleeve has been opened, the assembly 60 may be inserted into the wellbore 4 and continued pumping of the displacement fluid may drive the assembly 60 to a setting depth below a production zone Z. Meanwhile, the displaced fluid may be forced into a lower formation via the open toe sleeve.

Once the assembly 60 has been deployed to the setting depth, the disclosed plug 600 (e.g., degradable plug 100, 300, or 500 of FIGS. 1A-1J, 3A-3E, and 3A-5F) is set by supplying a signal (e.g., electricity at a first polarity) to the assembly 60 via the wireline 62 to activate a setting tool 66. As discussed above, the setting tool 66 may use a number of different components depending on the type of plug 100 being deployed and whether the plug 600 includes a mandrel that is maintained with the plug 600 or otherwise. In this example, the setting tool 66 drives a sleeve 22 toward a mule shoe 28 while a setting mandrel 26 restrains the plug 600, thereby compressing the elements of the plug 600 into engagement with the casing 10.

As shown in FIG. 6B, a tensile force can then be exerted on the assembly 60 by pulling the wireline 62 from the surface to release the plug 600 from the assembly 60. In the present example, the mule shoe 28 can shear free of the setting mandrel 26. As the mule shoe 28 falls in the wellbore 4, the assembly 60 is then raised using the wireline 62 until the perforation guns 64 are aligned with the production zone Z. A signal (e.g., electricity at a second polarity) can then be resupplied to the assembly 60 via the wireline 62 to fire the perforation guns 64 into the casing 10, thereby forming perforations 15. Once the perforations 15 have been formed, the assembly 60 may be retrieved to a lubricator (not shown) at surface using the wireline 62. A shutoff valve at the lubricator may then be closed.

As shown in FIG. 6C, a ball B or the like may then be released from a launcher (not shown) at the surface, and fracturing fluid may be pumped into the wellbore 4. As is known, the fracturing fluid may be a slurry including: proppant (e.g., sand), water, and chemical additives. Continued pumping of the fracturing fluid may drive the ball B toward the plug 600 until the ball B lands onto the plug 600, thereby closing off fluid flow through the plug 600.

Continued pumping of the fracturing fluid may exert pressure on the seated ball B until pressure in the casing 10 increases to force the fracturing fluid (above the seated ball B) through the perforations 15 and the cement 14 and into the production zone Z to create fractures. As is known, the proppant in the fracturing fluid may be deposited into the fractures. Pumping of the fracturing fluid may continue until a desired quantity has been pumped into the production zone Z.

Once the fracturing operation of the zone Z has been completed, additional stages can be fractured by repeating the above steps further up the wellbore 4.

Figure 7:
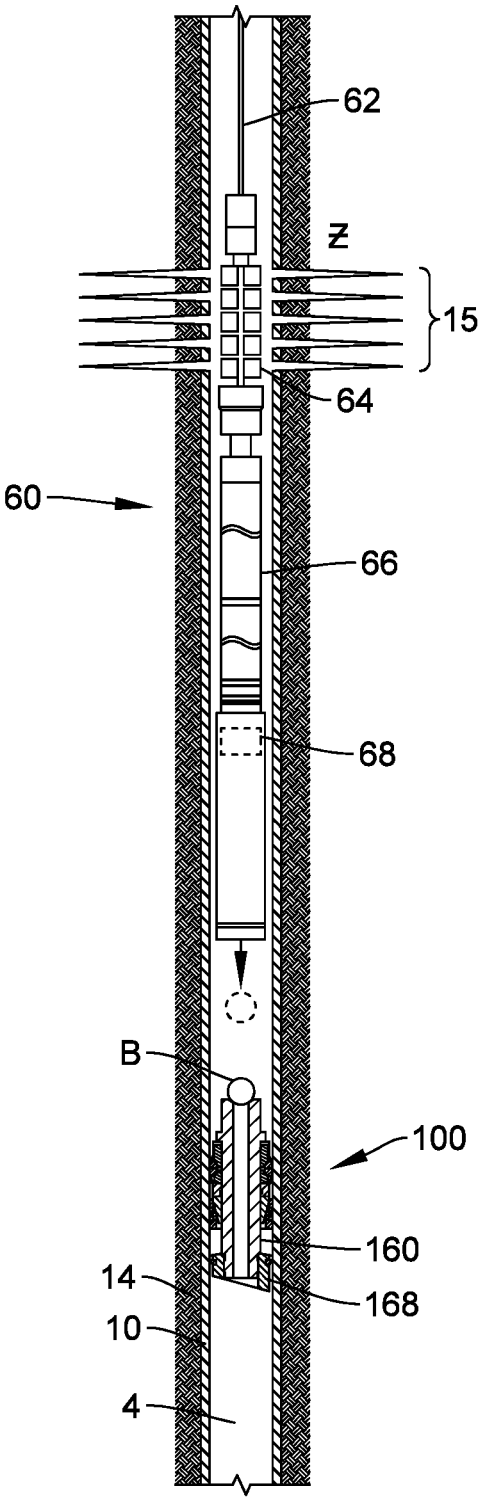
FIG. 7 illustrates a step of another example plug-and-perf operation with the disclosed plugs.

In the above arrangement, the ball B is deployed from a launcher at the surface after the assembly 60 has been removed. Other arrangements are possible. For example, FIG. 7 shows an embodiment of the assembly 60 run in hole and having a launcher 68 as part of the setting tool 66. After the plug 700 (e.g., degradable plug 200 or 400 of FIGS. 2A-2G and 4A-4E) is set in the casing 10, the assembly 60 is lifted, and the launcher 68 releases the ball B to land in the plug 700. Release from the launcher 68 can be triggered by a signal through the wireline 62, by release of the setting tool 66 from the plug 700, or other mechanism.

Figure 8:
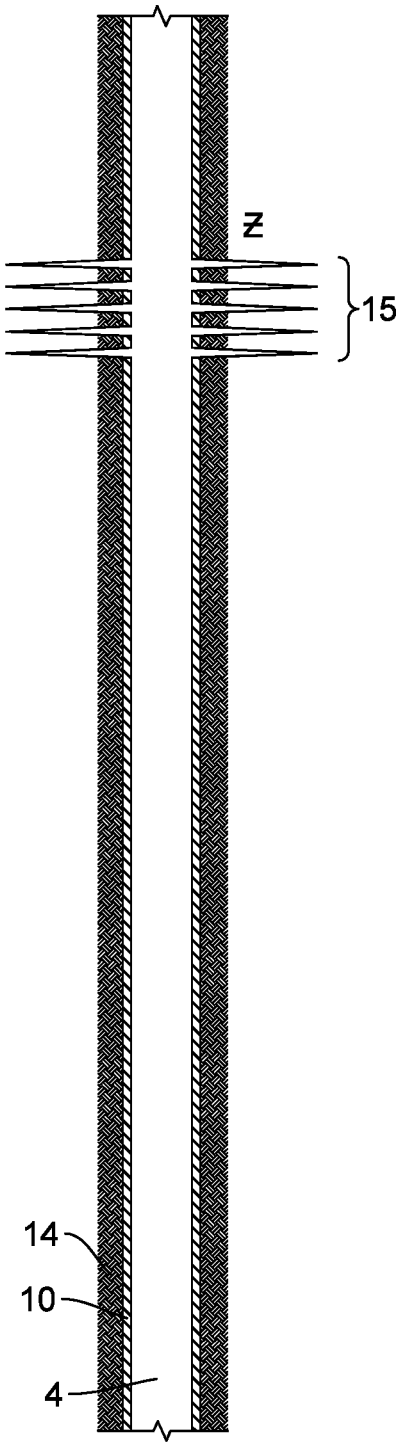
FIG. 8 illustrates the wellbore after dissolution of the disclosed plugs.

Then, the filler-doped degradable components of the plug degrade in response to the wellbore environment (e.g., via solubilization, hydrolytic degradation, biological dissolution and/or decomposition, chemical reactions, thermal reactions, reactions induced by radiation, or combinations thereof). Degradation of the filler-doped degradable components causes the degradable plug to break apart and restore flow through the wellbore between the zones separated by the plug. As shown in FIG. 8, the wellbore 4 may be cleared in the casing 10.

A first example embodiment of the present invention is a downhole apparatus for use in a tubular, the downhole apparatus comprising: a mandrel having a first end shoulder; a first slip disposed on the mandrel adjacent the first end shoulder and abutting against a mule shoe; a cone disposed on the mandrel adjacent the first slip and movable relative to the first end shoulder to engage the first slip toward the tubular; a seal element disposed on the mandrel adjacent the cone and being expandable outward from the mandrel; and wherein at least one component selected from the group consisting of the mandrel, the first slip, the cone, the seal element, and the mule shoe is a filler-doped degradable component that comprise a degradable material and a filler. The downhole apparatus can optionally include one or more of the following: Element 1: wherein the filler-doped degradable component is a first filler-doped degradable component, wherein the apparatus further comprises a ball for actuating the downhole apparatus, and wherein the ball is a second filler-doped degradable component; Element 2: wherein the filler is dispersed in the degradable material; Element 3: wherein the filler is a preform encased with the degradable material; Element 4: wherein the filler is at 10 vol % to 80 vol % of the filler-doped degradable component; Element 5: wherein the filler is at 50 vol % to 80 vol % of the filler-doped degradable component; Element 6: wherein the filler comprises one or more selected from the group consisting of: glass beads, hollow glass beads, sand, aluminum oxide particles, aluminum oxide particles, silicon carbide particles, tungsten carbide particles, and a combination thereof; Element 7: wherein the filler comprises one or more selected from the group consisting of: calcium carbonate, benzoic acid, magnesium oxide, sodium bicarbonate, sodium chloride, potassium chloride, calcium chloride, ammonium sulfate, and a combination thereof; Element 8: wherein the filler comprises one or more selected from the group consisting of: titanium particles, platinum particles, rhodium particles, gold particles, gold-platinum alloy particles, silver particles, and a combination thereof; Element 9: wherein the filler comprises one or more selected from the group consisting of: low-density polyethlyene, high density polyethylene, polypropylene, polyethlyene oxide, polypropylene oxide, polytetrafluoroethylene, phenolic resins, polyether ether ketone, nylon, and a combination thereof; Element 10: wherein the degradable material comprises one or more selected from the group consisting of: polylactic acid (PLA), polyglycolic acid (PGA), lactic acid/glycolic acid copolymer (PLGA), polyvinyl alcohol, polysaccharides, starches, polyanhydrides, polyorthoesters, polycaprolactones, and a combination thereof; Element 11: wherein the degradable material comprises one or more selected from the group consisting of: nickel, nickel-copper alloys, nickel-chromium alloys, aluminum, aluminum alloys, copper, copper alloys, chromium, tin, tin alloys, iron, iron alloys, zinc, zinc alloys, magnesium, magnesium alloys, beryllium, beryllium alloys, calcium alloys, and a combination thereof; Element 12: wherein at least one component is at least two components and the at least two components have different fillers; Element 13: wherein at least one component is at least two components and the at least two components have different volume percents of fillers; and Element 14: wherein at least one component is at least two components and the at least two components have different degradable materials.

Examples of combinations include, but are not limited to, two or more of Elements 6-9 in combination; one or more of Elements 6-9 in combination with Element 10 or 11; one or more of Elements 6-9 in combination with one or more of Elements 12-14 and optionally in further combination with Element 10 or 11; two or more of Elements 12-14 in combination; one or more of Elements 6-9 in combination with Element 2 or 3 and optionally in further combination with Element 10 or 11; two or more of Elements 12-14 in combination; Element 1 in combination with one or more of Elements 2-14; and Element 4 or 5 in combination with one or more of Elements 1-3 and 6-14.

Another embodiment is a method comprising: placing a downhole apparatus in a tubular downhole of a desired fracturing zone, wherein the downhole apparatus comprises: a mandrel having a first end shoulder; a first slip disposed on the mandrel adjacent the first end shoulder and abutting against a mule shoe; a cone disposed on the mandrel adjacent the first slip and movable relative to the first end shoulder to engage the first slip toward the tubular; a seal element disposed on the mandrel adjacent the cone and being expandable outward from the mandrel; and wherein at least one component selected from the group consisting of the mandrel, the first slip, the cone, the seal element, and the mule shoe is a filler-doped degradable component that comprise a degradable material and a filler; supplying a signal to the downhole apparatus causing the seal element to expand outward from the mandrel; performing a fracturing operation in the desired fracturing zone; and allowing the filler-doped degradable component to degrade. Optionally the method can further comprise one or more of the following: Element 2; Element 3; Element 4; Element 5; Element 6; Element 7; Element 8; Element 9; Element 10; Element 11; Element 12; Element 13; Element 14; and Element 15: wherein the filler-doped degradable component is a first filler-doped degradable component, wherein supplying the signal comprises sending a ball downhole, and wherein the ball is a second filler-doped degradable component. Examples of combinations include, but are not limited to, two or more of Elements 6-9 in combination; one or more of Elements 6-9 in combination with Element 10 or 11; one or more of Elements 6-9 in combination with one or more of Elements 12-14 and optionally in further combination with Element 10 or 11; two or more of Elements 12-14 in combination; one or more of Elements 6-9 in combination with Element 2 or 3 and optionally in further combination with Element 10 or 11; two or more of Elements 12-14 in combination; Element 4 or 5 in combination with one or more of Elements 2-3 and 6-14; and Element 15 in combination with one or more of Elements 2-14.

The foregoing description of preferred and other embodiments is not intended to limit or restrict the scope or applicability of the inventive concepts conceived of by the Applicants. It will be appreciated with the benefit of the present disclosure that features described above in accordance with any embodiment or aspect of the disclosed subject matter can be utilized, either alone or in combination, with any other described feature, in any other embodiment or aspect of the disclosed subject matter.

In exchange for disclosing the inventive concepts contained herein, the Applicants desire all patent rights afforded by the appended claims. Therefore, it is intended that the appended claims include all modifications and alterations to the full extent that they come within the scope of the following claims or the equivalents thereof.

Unless otherwise indicated, all numbers expressing quantities of ingredients, properties such as molecular weight, reaction conditions, and so forth used in the present specification and associated claims are to be understood as being modified in all instances by the term "about." Accordingly, unless indicated to the contrary, the numerical parameters set forth in the following specification and attached claims are approximations that may vary depending upon the desired properties sought to be obtained by the embodiments of the present invention. At the very least, and not as an attempt to limit the application of the doctrine of equivalents to the scope of the claim, each numerical parameter should at least be construed in light of the number of reported significant digits and by applying ordinary rounding techniques.

One or more illustrative embodiments incorporating the invention embodiments disclosed herein are presented herein. Not all features of a physical implementation are described or shown in this application for the sake of clarity. It is understood that in the development of a physical embodiment incorporating the embodiments of the present invention, numerous implementation-specific decisions must be made to achieve the developer's goals, such as compliance with system-related, business-related, government-related and other constraints, which vary by implementation and from time to time. While a developer's efforts might be time-consuming, such efforts would be, nevertheless, a routine undertaking for those of ordinary skill in the art and having benefit of this disclosure.

As used herein, each numerical parameter modified by the term "about" should at least be construed in light of the number of reported significant digits and by applying ordinary rounding techniques.

While compositions and methods are described herein in terms of "comprising" various components or steps, the compositions and methods can also "consist essentially of" or "consist of" the various components and steps.

Therefore, the present invention is well adapted to attain the ends and advantages mentioned as well as those that are inherent therein. The particular embodiments disclosed above are illustrative only, as the present invention may be modified and practiced in different but equivalent manners apparent to those skilled in the art having the benefit of the teachings herein. Furthermore, no limitations are intended to the details of construction or design herein shown, other than as described in the claims below. It is therefore evident that the particular illustrative embodiments disclosed above may be altered, combined, or modified and all such variations are considered within the scope and spirit of the present invention. The invention illustratively disclosed herein suitably may be practiced in the absence of any element that is not specifically disclosed herein and/or any optional element disclosed herein. While compositions and methods are described in terms of "comprising," "containing," or "including" various components or steps, the compositions and methods can also "consist essentially of" or "consist of" the various components and steps. All numbers and ranges disclosed above may vary by some amount. Whenever a numerical range with a lower limit and an upper limit is disclosed, any number and any included range falling within the range is specifically disclosed. In particular, every range of values (of the form, "from about a to about b," or, equivalently, "from approximately a to b," or, equivalently, "from approximately a-b") disclosed herein is to be understood to set forth every number and range encompassed within the broader range of values. Also, the terms in the claims have their plain, ordinary meaning unless otherwise explicitly and clearly defined by the patentee. Moreover, the indefinite articles "a" or "an," as used in the claims, are defined herein to mean one or more than one of the element that it introduces.

The invention claimed is:

1. A downhole apparatus for use in a tubular, the downhole apparatus comprising:

a mandrel having a first end shoulder;

a first slip disposed on the mandrel adjacent the first end shoulder and abutting against a mule shoe;

a cone disposed on the mandrel adjacent the first slip and movable relative to the first end shoulder to engage the first slip toward the tubular;

a seal element disposed on the mandrel adjacent the cone and being expandable outward from the mandrel; and wherein at least one component selected from the group consisting of the mandrel, the first slip, the cone, the seal element, and the mule shoe is a first filler-doped degradable component that comprise a degradable material and a filler, and wherein the apparatus further comprises a ball for actuating the downhole apparatus, and wherein the ball is a second filler-doped degradable component.

2. The downhole apparatus of claim 1, wherein the filler is dispersed in the degradable material.

3. The downhole apparatus of claim 1, wherein the filler is a preform encased with the degradable material.

4. The downhole apparatus of claim 1, wherein the filler is at 10 vol % to 80 vol % of the filler-doped degradable component.

5. The downhole apparatus of claim 1, wherein the filler is at 50 vol % to 80 vol % of the filler-doped degradable component.

6. The downhole apparatus of claim 1, wherein the filler comprises one or more selected from the group consisting of: glass beads, hollow glass beads, sand, aluminum oxide particles, aluminum oxide particles, silicon carbide particles, tungsten carbide particles, and a combination thereof.

7. The downhole apparatus of claim 1, wherein the filler comprises one or more selected from the group consisting of: calcium carbonate, benzoic acid, magnesium oxide, sodium bicarbonate, sodium chloride, potassium chloride, calcium chloride, ammonium sulfate, and a combination thereof.

8. The downhole apparatus of claim 1, wherein the filler comprises one or more selected from the group consisting of: titanium particles, platinum particles, rhodium particles, gold particles, gold-platinum alloy particles, silver particles, and a combination thereof.

9. The downhole apparatus of claim 1, wherein the filler comprises one or more selected from the group consisting of: low-density polyethlyene, high density polyethylene, polypropylene, polyethlyene oxide, polypropylene oxide, polytetrafluoroethylene, phenolic resins, polyether ether ketone, nylon, and a combination thereof.

10. The downhole apparatus of claim 1, wherein the degradable material comprises one or more selected from the group consisting of: polylactic acid (PLA), polyglycolic acid (PGA), lactic acid/glycolic acid copolymer (PLGA), polyvinyl alcohol, polysaccharides, starches, polyanhydrides, polyorthoesters, polycaprolactones, and a combination thereof.

11. The downhole apparatus of claim 1, wherein the degradable material comprises one or more selected from the group consisting of: nickel, nickel-copper alloys, nickel-chromium alloys, aluminum, aluminum alloys, copper, copper alloys, chromium, tin, tin alloys, iron, iron alloys, zinc, zinc alloys, magnesium, magnesium alloys, beryllium, beryllium alloys, calcium alloys, and a combination thereof.

12. The downhole apparatus of claim 1, wherein at least one component is at least two components and the at least two components have different fillers.

13. The downhole apparatus of claim 1, wherein at least one component is at least two components and the at least two components have different volume percents of fillers.

14. The downhole apparatus of claim 1, wherein at least one component is at least two components and the at least two components have different degradable materials.

15. A method comprising:

placing a downhole apparatus in a tubular downhole of a desired fracturing zone, wherein the downhole apparatus comprises:

a mandrel having a first end shoulder;

a first slip disposed on the mandrel adjacent the first end shoulder and abutting against a mule shoe;

a cone disposed on the mandrel adjacent the first slip and movable relative to the first end shoulder to engage the first slip toward the tubular;

a seal element disposed on the mandrel adjacent the cone and being expandable outward from the mandrel; and wherein at least one component selected from the group consisting of the mandrel, the first slip, the cone, the seal element, and the mule shoe is a first filler-doped degradable component that comprise a degradable material and a filler, and wherein the apparatus further comprises a ball for actuating the downhole apparatus, and wherein the ball is a second filler-doped degradable component;

supplying a signal to the downhole apparatus causing the seal element to expand outward from the mandrel;

performing a fracturing operation in the desired fracturing zone; and, allowing the filler-doped degradable component to degrade.

16. The method of claim 15, wherein the filler is dispersed in the degradable material.

17. The method of claim 15, wherein the filler is a preform encased with the degradable material.

18. The method of claim 15, wherein the filler is at 10 vol % to 80 vol % of the filler-doped degradable component.

19. A downhole apparatus for use in a tubular, the downhole apparatus comprising:

a mandrel having a first end shoulder;

a first slip disposed on the mandrel adjacent the first end shoulder and abutting against a mule shoe;

a cone disposed on the mandrel adjacent the first slip and movable relative to the first end shoulder to engage the first slip toward the tubular;

a seal element disposed on the mandrel adjacent the cone and being expandable outward from the mandrel; and wherein at least one component selected from the group consisting of the mandrel, the first slip, the cone, the seal element, and the mule shoe is a filler-doped degradable component that comprise a degradable material and a filler, and wherein the filler is a preform encased with the degradable material.

20. A method comprising:

placing a downhole apparatus in a tubular downhole of a desired fracturing zone, wherein the downhole apparatus comprises:

a mandrel having a first end shoulder;

a first slip disposed on the mandrel adjacent the first end shoulder and abutting against a mule shoe;

a cone disposed on the mandrel adjacent the first slip and movable relative to the first end shoulder to engage the first slip toward the tubular;

a seal element disposed on the mandrel adjacent the cone and being expandable outward from the mandrel; and wherein at least one component selected from the group consisting of the mandrel, the first slip, the cone, the seal element, and the mule shoe is a filler-doped degradable component that comprise a degradable material and a filler, and wherein the filler is a preform encased with the degradable material;

supplying a signal to the downhole apparatus causing the seal element to expand outward from the mandrel;

performing a fracturing operation in the desired fracturing zone; and, allowing the filler-doped degradable component to degrade.

* * * * *